US005915150A

United States Patent [19]

Kukimoto et al.

[11] Patent Number: 5,915,150

[45] Date of Patent: Jun. 22, 1999

[54] IMAGE FORMING METHOD UTILIZING TONER HAVING INORGANIC PARTICLES AND PARTICLES OF A SPECIFIC SPHERICITY

[75] Inventors: Tsutomu Kukimoto, Yokohama; Motoo Urawa, Funabashi; Shuichi Aita, Mishima; Satoshi Yoshida, Tokyo, all of Japan

[73] Assignee: Canon Kabushiki Kaisha, Tokyo, Japan

[21] Appl. No.: 08/803,506

[22] Filed: Feb. 20, 1997

[30] Foreign Application Priority Data

Feb. 20, 1996 [JP] Japan ..... 8-055405

[51] Int. Cl.[6] ..... G03G 15/30

[52] U.S. Cl. ..... 399/149; 399/252; 430/109; 430/111

[58] Field of Search ..... 399/149, 150, 399/174–176, 252, 259; 430/109–111

[56] References Cited

U.S. PATENT DOCUMENTS

| | | | |
|---|---|---|---|
| 4,769,676 | 9/1988 | Mukai et al. . | |
| 4,843,424 | 6/1989 | Oda et al. . | |
| 4,851,960 | 7/1989 | Nakamura et al. | 361/255 |
| 4,957,840 | 9/1990 | Sakashita et al. | 430/106.6 |
| 5,014,089 | 5/1991 | Sakashita et al. . | |
| 5,137,796 | 8/1992 | Takiguchi et al. | 430/106.6 |
| 5,262,267 | 11/1993 | Takiguchi et al. | 430/122 |
| 5,270,143 | 12/1993 | Tomiyamo et al. | 430/109 |
| 5,282,007 | 1/1994 | Oshiumi . | |
| 5,283,618 | 2/1994 | Hosoya et al. . | |
| 5,305,061 | 4/1994 | Takama et al. | 399/175 X |
| 5,310,615 | 5/1994 | Tanikawa | 430/106.6 |
| 5,328,792 | 7/1994 | Shigemori et al. | 430/106.6 |
| 5,450,180 | 9/1995 | Ohzeki et al. . | |
| 5,659,857 | 8/1997 | Yamazaki et al. | 430/109 |

FOREIGN PATENT DOCUMENTS

| | | |
|---|---|---|
| 330498 | 8/1989 | European Pat. Off. . |
| 575159 | 12/1993 | European Pat. Off. . |
| 59-133573 | 7/1984 | Japan . |
| 61-279864 | 12/1986 | Japan . |
| 62-203182 | 9/1987 | Japan . |
| 63-133179 | 6/1988 | Japan . |
| 63-149669 | 6/1988 | Japan . |
| 63-235953 | 9/1988 | Japan . |
| 64-20587 | 1/1989 | Japan . |
| 1-112253 | 4/1989 | Japan . |
| 1-191156 | 8/1989 | Japan . |
| 2-51168 | 2/1990 | Japan . |
| 2-123385 | 5/1990 | Japan . |
| 2-284156 | 11/1990 | Japan . |
| 2-284158 | 11/1990 | Japan . |
| 2-302772 | 12/1990 | Japan . |
| 3-181952 | 8/1991 | Japan . |
| 3-259161 | 11/1991 | Japan . |
| 4-162048 | 6/1992 | Japan . |
| 5-2287 | 1/1993 | Japan . |
| 5-2289 | 1/1993 | Japan . |
| 5-54382 | 3/1993 | Japan . |
| 5-61383 | 3/1993 | Japan . |

OTHER PUBLICATIONS

European Search Report.

*Primary Examiner*—William J. Royer
*Attorney, Agent, or Firm*—Fitzpatrick, Cella, Harper & Scinto

[57] ABSTRACT

An electrophotographic image forming method according to (I) a so-called simultaneous development and cleaning scheme or cleaner-less scheme is effectively operated by using a specific non-magnetic toner. (II) The non-magnetic toner comprises non-magnetic toner particles having a shape factor SF-1 of 120–160, a shape factor SF-2 of 115–140 and a weight-average particle size of 4–9 μm. (III) The non-magnetic toner further includes inorganic fine particles (a) having a number-average primary particle size of at most 50 nm and spherical fine particles (b) having a number-average primary particle size of 50–1000 nm and a surface area-based sphericity ψ of 0.91–1.00, respectively externally added to the non-magnetic toner particles.

37 Claims, 12 Drawing Sheets

IMAGE FORMING METHOD UTILIZING TONER HAVING INORGANIC PARTICLES AND PARTICLES OF A SPECIFIC SPHERICITY

FIELD OF THE INVENTION AND RELATED ART

The present invention relates to an image forming method (or image recording method) utilizing electrophotography, electrostatic recording, etc. More specifically, the present invention relates to an image forming method wherein a toner image is formed on an electrostatic image-bearing member and transferred onto a transfer-receiving member to form an image thereon, as used in a copying machine, a printer or a facsimile apparatus.

Hitherto, a large number of electrophotographic processes have been known. In these processes, in general, an electrostatic latent image is formed on a photosensitive member comprising a photoconductive material by various means, then the latent image is developed with a toner, and the resultant toner image is, after being transferred onto a transfer material such as paper, as desired, fixed by heating and/or pressing to obtain a copy or a print.

Known methods of developing electrostatic latent images include the cascade developing method, the magnetic brush developing method, the pressure developing method, and the mono-component developing method. Further, there is also known a developing method, as a type of the mono-component developing method, wherein a magnetic toner is used in combination with a rotating sleeve containing a magnet therein and is caused to jump between the sleeve and a photosensitive member under application of an electric field.

The mono-component developing scheme has an advantage of allowing a developing device which is compact and light in weight, since it does not require carrier particles, such as glass beads, iron powder or magnetic ferrite carrier particles, as required in a two-component developing scheme. Further, according to the two-component developing scheme, it is necessary to maintain a constant toner concentration in a developer mixture with carrier particles and therefore to use equipment for detecting the toner concentration and replenishing a necessary amount of toner. This also increases the weight of the developing device. The mono-component developing scheme does not require such equipment and therefore can use a compact and light developing device.

As for printing apparatus utilizing electrophotography, LBP printers and LED printers dominate in the market, and technically a higher resolution is being desired, e.g., from a conventional level of 240 or 300 dpi to 400 dpi, 600 dpi or 800 dpi. Correspondingly, a developing scheme of a higher resolution is required. As for copying apparatus, a higher degree of functional apparatus is being desired so that digital image formation is pursued. A digital copying apparatus principally adopts a scheme of forming electrostatic images by laser irradiation suitable for a high resolution image formation. Thus, a developing scheme of a higher resolution or higher definition is also required similarly as in printers. For this reason, a toner of a smaller particle size is being used, and toners of a smaller particle size having a specific particle size distribution have been proposed in Japanese Laid-Open Patent Application JP-A 1-112253, JP-A 1-191156, JP-A 2-284156, JP-A 2-284158, JP-A 3-181952 and JP-A 4-162048.

A toner image formed on a photosensitive member is transferred onto a transfer(-receiving) material in a transfer step, and a portion of toner remaining on the photosensitive member after the transfer step (i.e., a transfer residual toner) is removed in a cleaning step to be recovered into a waste toner vessel. In the cleaning step, a blade, a fur brush, a roller, etc., have been conventionally used as cleaning means. By cleaning means or member, the transfer residual toner is mechanically scraped off or held back to be recovered into a waste toner vessel. Accordingly, some problems have been caused by pressing of such a cleaning member against the photosensitive member surface. For example, by strongly pressing the member, the photosensitive member can be worn out to result in a short life of the photosensitive member. Further, from an apparatus viewpoint, the entire apparatus is naturally enlarged because of the provision of such a cleaning device, thus providing an obstacle against a general demand for a smaller apparatus.

Further, from a viewpoint of environmental hygiene and effective utilization of a toner, a system not resulting in a waste toner or resulting in only a small amount of waste toner has been desired, and accordingly a toner exhibiting a good transfer efficiency has been desired.

On the other hand, a simultaneous developing and cleaning system or so-called cleaner-less system has been proposed, e.g., in Japanese Laid-Open Patent Application JP-A 5-2287, so as to solve image defects of a positive memory, a negative memory, etc., due to such transfer residual toner. However, in these days when the utilization of electrophotography has been extensively developed, it has become necessary to transfer such toner images onto various transfer(-receiving) material, and accordingly a toner exhibiting good transfer characteristics onto various transfer materials is desired.

JP-A 2-51168 has proposed the use of a spherical toner prepared by polymerization and a spherical carrier and does not refer to any toners produced through the pulverization process.

The above-mentioned publications JP-A 59-133573, JP-A 62-203182, JP-A 63-133179, JP-A 64-20587, JP-A 2-302772, JP-A 5-2289, JP-A 5-54382 and JP-A 5-61383 regarding the the hitherto proposed cleaner-less systems do not refer to specific compositions of toners used therein. Some of them have proposed to obviate difficulties during imagewise exposure arising from a transfer residual toner, e.g., by irradiating high-intensity light or using a toner transmitting a certain wavelength of the exposure light.

However, by only using such an intensified exposure light, electrostatic latent image dots are liable to be blurred so that the reproducibility of individual dots can be impaired to result in an inferior resolution and a graphic image having insufficient gradation.

On the other hand, the use of a toner transmitting exposure wavelength light generally shows little effect because the interruption of exposure light is caused mainly by exposure light scattering at the toner particle surfaces rather than by the color of the toner per se. Further, this measure restricts the latitude of toner colorant selection and requires at least three exposure means issuing different wavelengths of light in case of full color image formation. This is clearly against the object of providing a simpler apparatus, that is a characteristic of the simultaneous development and cleaning system.

Further, in the simultaneous development and cleaning system including essentially no cleaning device, it is preferred to rub or scrape the electrostatic image-bearing member surface with the toner and toner-carrying member held by the developing means. This is liable to result in difficulties in a long period of use, such as the deterioration of the toner, the surface deterioration of the toner-carrying member and the surface deterioration or abrasion of the electrostatic image-bearing member, all leading to a deterioration in continuous or long-term image forming characteristics of which a solution has been desired.

JP-A 3-259161 has proposed a non-magnetic mono-component developer having a specified shape factor, a specified specific surface area and a specific particle size, which developer has however left room for improvement regarding the durability or continuous image forming characteristics.

JP-A 61-279864 has proposed a toner having a shape factor SF-1 of 120–180 and a shape factor SF-2 of 110–130. However, as a result of trace experiment of Examples of the publication, the resultant toner showed a low transfer efficiency, requiring a further improvement.

Further, JP-A 63-235953 has proposed a magnetic toner sphered under application of a mechanical impact force, which toner however requires a further improvement in transfer efficiency.

In recent years, attention has been called to a primary charging or/and a transfer process using a contact charging member abutted against a photosensitive member in contrast with the conventional primary charging and transfer process utilizing corona discharge from an ecological viewpoint. Such contact charging process and contact transfer process have been proposed in, e.g., JP-A 63-149669 and JP-A 2-123385. Image-forming methods disclosed in these publications including a charging step for uniformly charging an electrostatic image-bearing member by abutting an electroconductive elastic roller for charging against the image-bearing member while supplying a voltage to the roller, an exposure step for exposing the charged image-bearing member, a developing step for forming a toner image on the image-bearing member, a transfer step of passing a transfer material between the image-bearing member carrying the toner image and an electroconductive roller supplied with a voltage for transfer abutted against the image-bearing member to transfer the toner image onto the transfer material, and a fixing step for providing a fixed image.

However, in such a roller transfer scheme not utilizing the corona discharge, the transfer roller is abutted via the transfer material against the photosensitive member (image-bearing member), so that the toner image is compressed during transfer thereof from the photosensitive member to the transfer material, thus being liable to cause a partial transfer failure, called transfer dropout or hollow image (as illustrated in FIG. 12B).

A toner having a smaller diameter is caused to have a relatively large force of attachment of toner particles onto the photosensitive member (such as an image force and van der Waals force) relative to a Coulomb's force acting onto the toner particles during the transfer, thus being liable to result in an increased amount of transfer residual toner.

Accordingly, such image forming methods including a contact transfer process have required a toner and a photosensitive member having good releasability.

SUMMARY OF THE INVENTION

A generic object of the present invention is to provide an image forming method having solved the above-mentioned problems of the prior art.

A more specific object of the present invention is to provide an image-forming method which suffers from no or only little positive or negative memory.

Another object of the present invention is to provide an image forming method capable of exhibiting a good transferability on various transfer materials, inclusive of thick paper and transparent films for overhead projectors.

Another object of the present invention is to provide an image forming method not requiring a cleaning device exclusively used for cleaning the surface of an electrostatic image-bearing member.

Another object of the present invention is to provide an image forming method wherein a toner is allowed to exhibit an excellent transferability, leave little transfer residual toner and cause no or well-suppressed transfer dropout.

According to the present invention, there is provided an image forming method, comprising:

a charging step of charging an electrostatic latent image-bearing member by charging means, an exposure step of exposing the charged image-bearing member to form an electrostatic latent image thereon, a developing step of developing the electrostatic latent image with a non-magnetic toner held by developing means to form a toner image on the image-bearing member, and a transfer step of transferring the toner image on the image bearing member onto a transfer material via or not via an intermediate transfer member, wherein (I) a portion of the toner remaining on the image bearing member after the transfer step is recovered by the developing means during a subsequent developing step;

(II) the non-magnetic toner comprises non-magnetic toner particles having a shape factor SF-1 of 120–160, a shape factor SF-2 of 115–140 and a weight-average particle size of 4–9 $\mu$m; and (III) the non-magnetic toner further includes inorganic fine particles (a) having a number-average primary particle size of at most 50 nm and spherical fine particles (b) having a number-average primary particle size of 50–1000 nm and a surface area-based sphericity $\psi$ of 0.91–1.00, respectively externally added to the non-magnetic toner particles.

These and other objects, features and advantages of the present invention will become more apparent upon a consideration of the following description of the preferred embodiments of the present invention taken in conjunction with the accompanying drawings.

DETAILED DESCRIPTION OF THE INVENTION

According to the present invention, it is possible to essentially prevent an undesirable phenomenon of positive memory or negative memory liable to occur in a so-called cleaner-less system or simultaneous development and cleaning system not equipped with a cleaning device for exclusive use.

The shape factors SF-1 and SF-2 of non-magnetic toner particles referred to herein are values measured in the following manner. An amount of sample toner particles or sample toner (which can include external additives including the inorganic fine particles (a) and the spherical fine particles (b) in addition to the toner particles without substantially adversely affecting the measured value in view of a size difference) is taken and observed through a field-emission scanning electron microscope ("FE-SEM S-800", available from Hitachi Seisakusho K.K.) at a magnification of 1000, and images of 1000 toner particles having a particle size (diameter) of 2 $\mu$m or larger are sampled at random. The image data are inputted to an image analyzer ("Luzex 3", available from Nireco K.K.) to obtain averages of shape factors SF-1 and SF-2 based on the following equations:

$$SF\text{-}1=[(MXLNG)^2/AREA]\times(\pi/4)\times100,$$

$$SF\text{-}2=[(PERIME)^2/AREA]\times(1/4\pi)\times100,]$$

wherein MXLNG denotes the maximum of a sample particle, PERIME denotes the perimeter of a sample particle, and AREA denotes the projection area of the sample particle.

The shape factor SF-1 represents the roundness of toner particles, and the shape factor SF-2 represents the unevenness of toner particles.

A toner having a shape factor SF-1 of below 120 or a shape factor SF-2 of below 115 is generally liable to cause toner sticking onto a toner-carrying member. A toner having a shape factor SF-1 exceeding 160 has a shape leaving from a sphere to approach an indefinite shape and is liable to be broken within a developer vessel to cause a change in particle size distribution or a broader triboelectric charge distribution, which leads to ground fog or reversal fog. A toner having an SF-2 exceeding 140 is liable to cause a lowering in efficiency of transfer from the electrostatic latent image-bearing member to a transfer(-receiving) material and transfer dropout (hollow image) in reproduction of characters or line images. It is preferred to use non-magnetic toner particles prepared through the pulverization process after a surface treatment for sphering.

Figure 13:
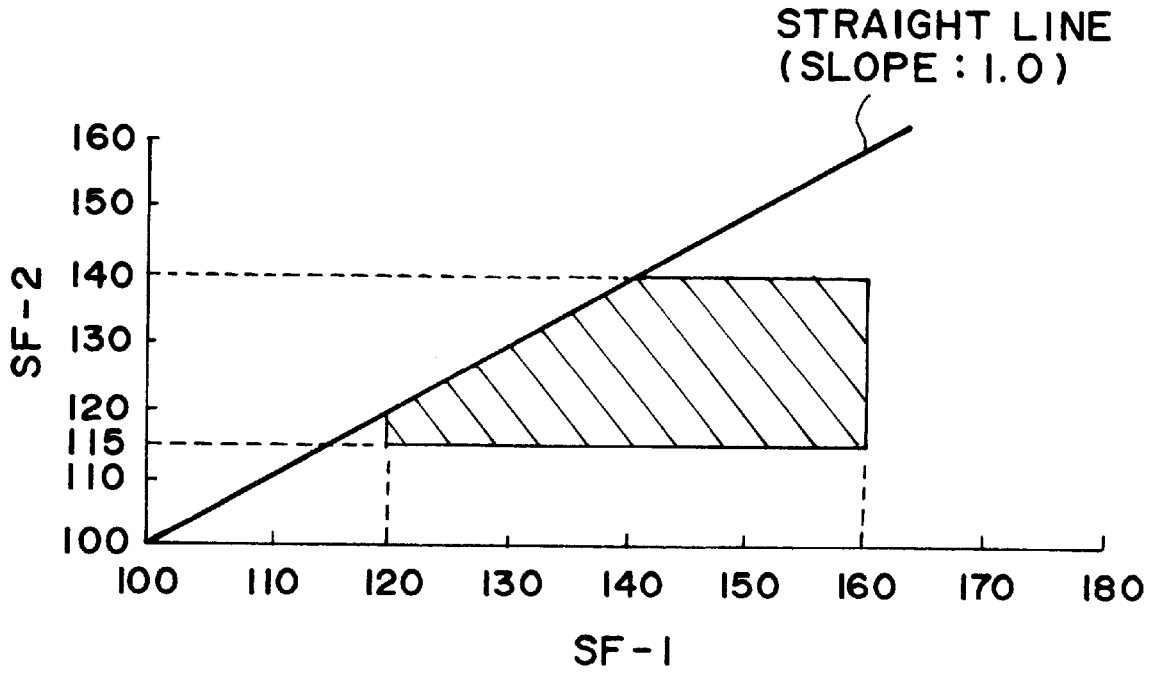
FIG. 13 is a graph showing ranges of shape factors SF-1 and SF-2 of non-magnetic toner particles suitably used in the invention.

A ratio B/A between a value B obtained by subtracting 100 from an SF-2 value and a value A obtained by subtracting 100 from an SF-1 value, represents a straight line passing through an origin of a coordinate system as shown in FIG. 13, and the ratio B/A may preferably be at most 1.0, more preferably 0.2–0.9, further preferably 0.35–0.85, so as to have the non-magnetic toner particles exhibit an improved transferability while retaining a good developing performance.

The non-magnetic toner used in the image forming method according to the present invention is in the form of a mixture of such non-magnetic toner particles having an SF-1 of 120–160, an SF-2 of 115–140 and a weight-average particle size of 4–9 $\mu$m with inorganic fine particles (a) having a number-average primary particle size of at most 50 nm and spherical fine particles (b) having a number-average primary particle size of 50–1000 nm and a surface area-based sphericity $\psi$ of 0.91–1.00, respectively externally added to the non-magnetic toner particles. As a result, the non-magnetic toner exhibits an excellent transferability and an excellent continuous image forming performance, allows easy recovery thereof during the developing step even if left as a transfer residual toner on the image-bearing member after the transfer step, and also exhibits an excellent dot reproducibility of digital latent images.

As the inorganic fine particles (a) and the spherical fine particles (b) are carried on the non-magnetic toner particles, it becomes possible to better obviate the transfer dropout of character images or line images of the non-magnetic toner.

In the present invention, it is preferred that the non-magnetic toner (including the particles (a) and (b)) has a BET specific surface area Sb ($m^2/cm^3$) as measured according to the BET method using nitrogen gas as the adsorbate and a geometrical specific surface area St ($=6/D_4$) ($m^2/cm^2$)) based on an assumption that it consists exclusively of true-spherical non-magnetic toner particles each having their weight-average particle size ($D_4$), satisfying:

$$3.0\leqq Sb/St\leqq 7.0 \text{ and } Sb\geqq St\times1.5+1.5.$$

It is further preferred that the non-magnetic toner (more specifically the toner particles thereof) has a number-average particle size $D_1$ ($\mu$m) satisfying: $10<D_1\times Sb\leqq 50$, more preferably $15<D_1\times Sb\leqq 40$. $D_1$ may preferably be 3.5–8.0 $\mu$m. Sb may preferably be 3.2–6.8 $m^2/cm^3$, more preferably 3.4–6.3 $m^2/cm^3$.

The volume of a sample toner may be calculated from its weight by using a true density as measured by, e.g., a dry type automatic density meter ("Accupyc 1330", available from K.K. Shimadzu Seisakusho). The true density-measurement method may be applicable to other powdery materials.

If the ratio Sb/St is below 3.0, the transfer efficiency is liable to be lowered and in excess of 70, the toner is liable to result in a lower image density. This is presumably attributable to the function of the inorganic fine particles (a) and the spherical fine particles (b) as spacers between the non-magnetic toner particles and the toner-carrying member and between the non-magnetic toner particles and the electrostatic latent image-bearing member.

The above-mentioned requirement for the BET specific area Sb of the non-magnetic toner may be accomplished by controlling the specific surface area of the non-magnetic toner particles, the specific surface areas and addition amounts of the inorganic fine particles (a) and the spherical fine particles (b) added to the toner particles, and the intensity of blending these particles.

Further, in order to effectively utilize the inorganic fine particles (a) and the spherical fine particles (b), it is preferred that the toner particles have a BET specific surface area Sr of 1.2–2.5 $m^2/cm^3$, more preferably 1.4–2.1 $m^2/cm^3$, and the BET specific surface area is 1.5–2.5 times the above-mentioned St (i.e., a geometrical specific surface area (=6/$D_4$) based on an assumption that the toner particles are exclusively composed of true-spherical particles each having a weight-average particle size ($D_4$) thereof).

Further, it is preferred the BET specific surface area Sb of the non-magnetic toner after the addition of the fine particles (a) and (b) is larger by at least 1.5 $m^2/cm^3$ than the BET specific surface area Sr of the non-magnetic toner particles. The non-magnetic toner particles before the addition of the fine particles (a) and (b) may preferably provide such a pore radius distribution (as a measure of surface roughness) as to give a pore area distribution in the pore radius range of 1–100 nm exhibiting a 60% pore radius (i.e., a radius giving an accumulative pore area of 60%) of at most 3.5 nm. It is further preferred that the BET specific surface area Sb of the non-magnetic toner and the BET specific surface area Sr of the toner particles give a ratio Sb/Sr in the range of 2–5.

The satisfaction of the above-mentioned 60% pore radius conditions is considered to be effective for reducing pores or unevennesses larger than the primary particle size of the fine particles (a), whereby the fine particles (a) are further effectively utilized to improve the transfer efficiency.

The specific surface areas Sb and St referred to herein are based on values measured by using a BET specific surface area measurement apparatus ("Autosorb 1", available from Yuasa Ionix K.K.) according to the BET multi-point method using nitrogen gas as an adsorbate onto a sample surface. The 60% pore radius is determined from an accumulative pore area-pore radius curve on the desorption side. The pore radius distribution is calculated according to the BJH method (proposed by Barret, Joyner & Harenda) based on adsorption test data obtained by Autosorb 1.

In order to provide a higher quality image by faithfully developing more minute dots, toner particles having a weight-average particle size of 4–9 $\mu$m are used in the present invention. Toner particles having a weight-average particle size below 4 $\mu$m are liable to leave an increased amount of transfer residual toner on the photosensitive member because of a lowering in transfer efficiency and cause image irregularity because of fog and transfer failure so that they are not preferred in the present invention. On the other hand, toner particles having a weight-average particle size in excess of 9 $\mu$m are liable to cause scattering of character and line images.

The particle size distribution and average particle size of toner particles or a toner referred to herein are based on values measured by using a Coulter counter Model TA-II (or Coulter Multisizer) (available from Coulter Electronics Inc.), to which are connected an interface (available from Nikkaki K.K.) for outputting number-basis and weight-basis distributions and a personal computer ("PC-9801", available from NEC K.K.). As an electrolytic solution, a 1% NaCl aqueous solution may be prepared by using a reagent-grade sodium chloride. Alternatively, it is possible to use a commercially available electrolytic solution (e.g., "ISOTON R-II", available from Coulter Scientific Japan K.K.).

For measurement, into 100 to 150 ml of the electrolytic solution, 0.1 to 5 ml of a surfactant, preferably an alkylbenzenesulfonic acid salt, is added as a dispersant, and 2 to 20 mg of a sample is added thereto. (A toner including external additives, such as the inorganic fine particles (a) and the spherical fine particles (b), in addition to toner particles, may conveniently be used as the sample without substantially adversely affecting the measurement of the toner particle sizes in view of a size difference.) The resultant dispersion of the sample in the electrolytic liquid is subjected to a dispersion treatment for about 1–3 minutes by means of an ultrasonic disperser, and then subjected to measurement of particle size distribution in the range of 2 $\mu$m or larger by using the above-mentioned apparatus (preferably Coulter Counter Model TA-II) with a 100 $\mu$m-aperture to obtain a volume-basis distribution and a number-basis distribution.

The weight-basis average particle size $D_4$ and the number-basis average particle size $D_1$ may be obtained from the volume-basis distribution and the number-basis distribution, respectively, while a central value in each channel is taken as a representative value for each channel.

The non-magnetic toner used in the present invention may preferably have a chargeability per unit weight of 30–80 mC/kg, more preferably 40–70 mC/kg, as measured in the following manner according to the two-component method, so as to provide an improved transfer efficiency when applied to a transfer process using a transfer member supplied with a voltage.

Figure 11:
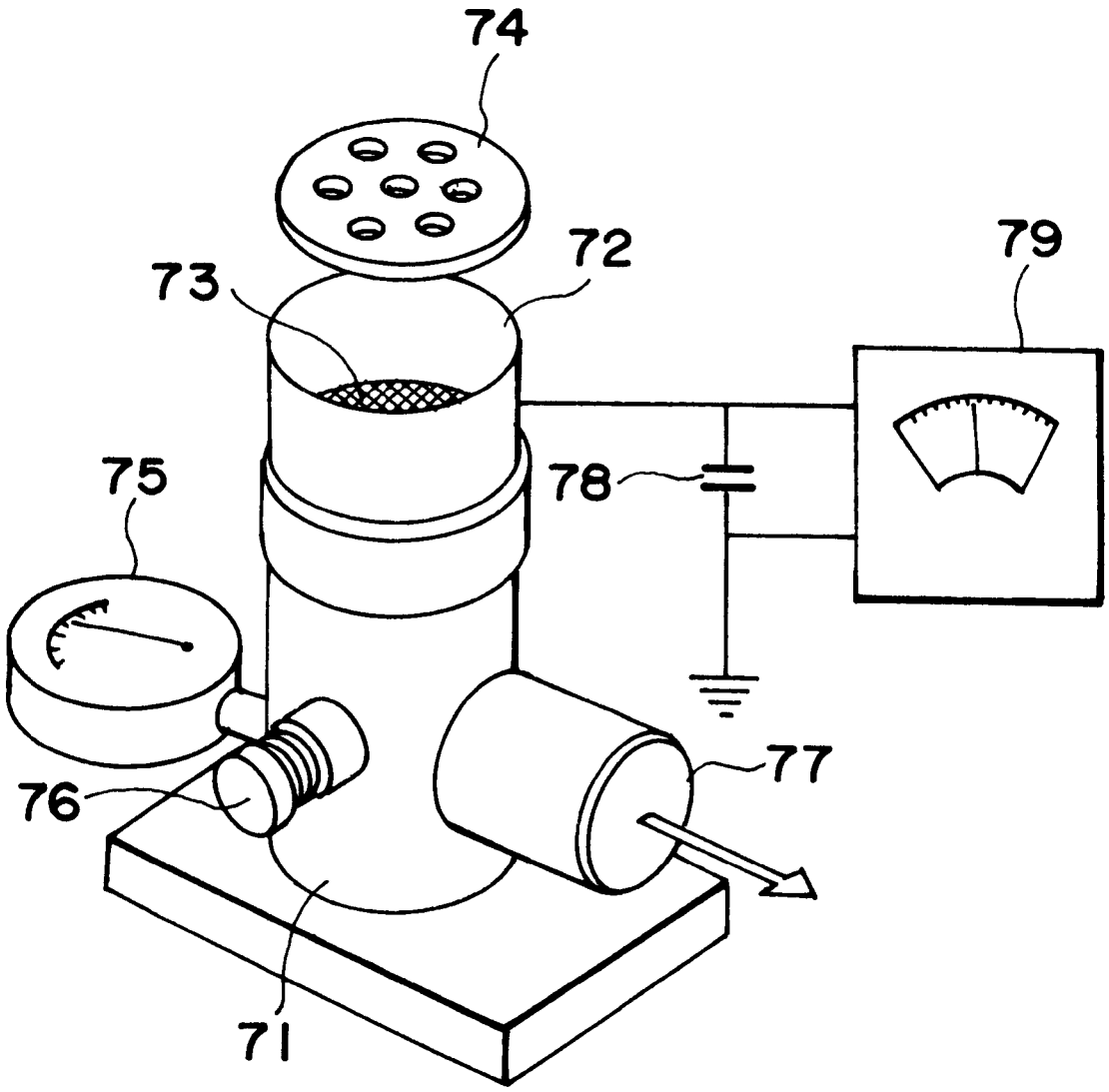
FIG. 11 is an illustration of an apparatus for measuring triboelectric chargeability of toner.
Figure 12A:
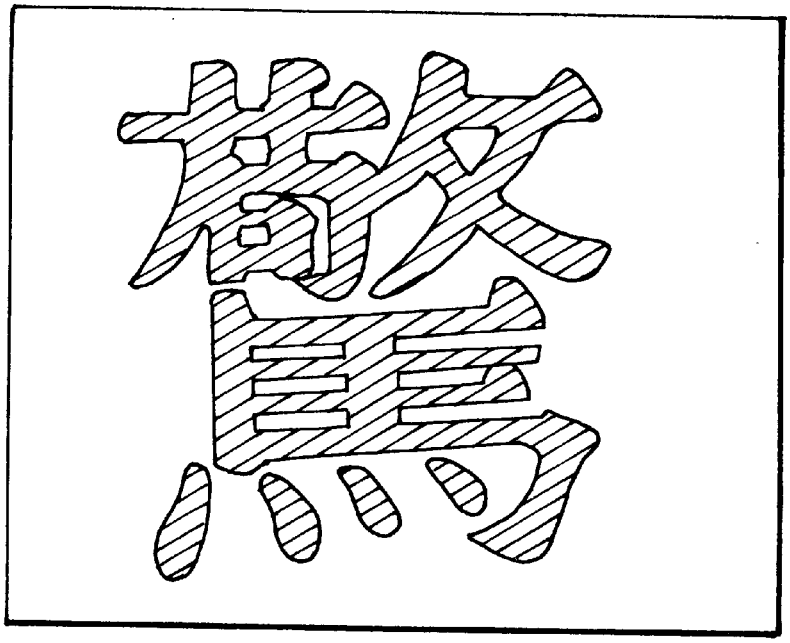
FIGS. 12A and 12B illustrate a good reproduced image free from transfer dropout and an inferior reproduced image accompanied with transfer dropout (hollow image), respectively.
Figure 12B:
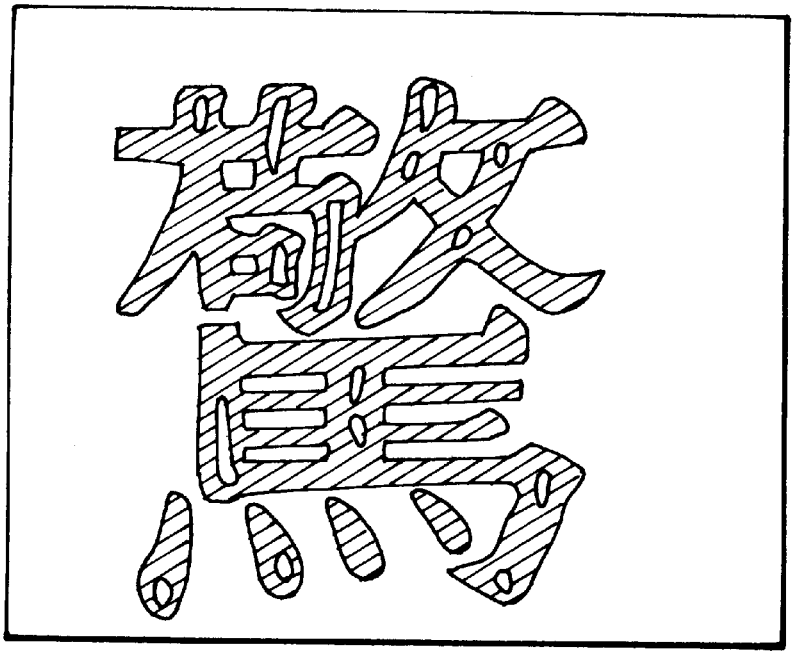

In an environment of temperature 23° C. and relative humidity 60%, 9.5 g of iron powder having particle sizes between 200 mesh and 300 mesh ("EFV200/300", available from POWDERTEC K.K.) is blended with 0.5 g of a sample toner, and the resultant mixture is placed in a polyethylene bottle in a volume of 50–100 ml, followed by 50 times of shaking by hands. Then, 1.0–1.2 g of the shaken mixture is charged in a metal container 72 for measurement provided with a 500-mesh screen 73 at its bottom as shown in FIG. 11 and covered with a metal lid 74. The total weight of the container 72 is weighed and denoted by $W_1$ (g). Then an aspirator 71 composed of an insulating material at least with respect to a part contacting the container 72 is operated, and the toner in the container is removed by suction through a suction port 77 for 1 min. while controlling the pressure at a pressure gauge 75 at 2450 Pa (250 mmAq) by adjusting an aspiration control valve 76. The reading at this time of a potentiometer 79 connected to the container via a capacitor 78 having a capacitance C ($\mu$F) is denoted by V (volts). The total weight of the container after the aspiration is measured and denoted by $W_2$ (g). Then, the triboelectric charge T (mC/kg) is calculated as: $T\ (mC/kg)=C\times V/(W_1-W_2)$.

The non-magnetic toner particles may preferably comprise a binder resin having a molecular weight distribution according to GPC (gel permeation chromatography) providing a lower molecular weight side peak in the molecular weight range of 3000–15000 for adequately controlling the shape of toner particles prepared through the pulverization process by application of a thermal and mechanical impact force. In case where the lower-molecular weight-side peak molecular weight exceeds 15000, it becomes difficult to control the shape factors SF-1 and SF-2 within the ranges of the present invention. If the peak molecular weight is below 3000, the toner particles are liable to cause a melt sticking within an apparatus for a surface treatment thereof. Molecular weight and distribution of a toner binder resin referred to herein are based on the following GPC measurement. A toner sample is preliminarily subjected to extraction with solvent tetrahydrofuran (THF) for 20 hours by means of Soxhlet's extractor to prepare a GPC sample, which is then subjected to GPC by using a series of columns (e.g., A-801 802, 803, 804, 805, 806 and 807, all available from Showa Denko K.K.) to measure a molecular weight distribution based on a calibration curve obtained by standard polystyrene resins.

It is preferred to use a binder resin having a ratio Mw/Mn of 2–100 between the weight-average molecular weight (Mw) and number-average molecular weight (Mn).

The toner may preferably have glass transition temperature Tg in the range of 50–75° C., further preferably 52–70° C., in view of its fixability and storage stability.

The glass transition temperature Tg of a toner may be measured by using a high-accuracy internal heating input compensation-type differential scanning calorimeter (DSC) (e.g., "DSC-7", available from Perkin-Elmer Corp.). The measurement may be performed according to ASTM D3418-82. Before a DSC curve is taken, a sample is once heated and quenched for removing its thermal history and then again subjected to heating at a temperature raising rate of 10° C./min in a temperature range of 0–200° C. for taking DSC curves.

The toner binder resin may for example comprise: polystyrene; homopolymers of styrene derivatives, such as poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include crosslinked styrene resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

In order to provide an improved releasability from a fixing member and also an improved fixability during a hot pressure fixation, it is also preferred to incorporate a wax into toner particles. Examples of such waxes may include: paraffin wax and derivatives thereof, microcrystalline wax and derivatives thereof, Fischer-Tropsh wax and derivatives thereof, polyolefin wax and derivatives thereof, and carnauba wax and derivatives thereof. The derivatives may include: oxides, block copolymers with a vinyl monomer, and graft-modification products.

In addition, it is also possible to use long-chain alcohols, long-chain aliphatic acids, acid amides, esters, ketones, cured castor oil, and derivatives thereof, vegetable waxes, animal waxes, mineral waxes, and petrolactam.

It is preferred to incorporate a charge control agent to the toner particles (internal addition) or blend a charge control agent with the toner particles (external addition). By using such a negative or positive charge control agent, it becomes possible to effect an optimum charge control suitable for the developing system.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate. These may be used singly or in mixture of two or more species.

The charge control agent may preferably be used in a fine particulate form, having a number-average particle size of at most 4 μm, particularly at most 3 μm. In the case of the internal addition to the toner particles, the charge control agent may preferably be used in an amount of 0.1–20 wt. parts, particularly 0.2–10 wt. parts, per 100 wt. parts of the binder resin.

The non-magnetic toner may contain a colorant. For example, it is possible to use a black colorant, such as carbon black or a black colorant mixture of yellow/magenta and cyan colorants as described below.

Examples of the yellow colorant may include: condensed azo compounds, isoindolinone compounds, anthraquinone compounds, azo metal complexes, methine compounds and acrylamide compounds as representatives. Preferable specific examples thereof may include: C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191.

Examples of the magenta colorant may include: condensed azo compounds, diketopyrolopyrrole compounds, anthraquinone compounds, quinacridone compounds, basic dye lake compounds, naphthol compounds, benzimidazolone compounds, thioindigo compounds and perylene compounds. Preferred specific examples thereof may include: C.I. Pigment Red 2, 3, 5, 6, 7, 23, 48:2, 48:3, 48:4, 57:1, 81:1, 114, 146, 166, 169, 177, 184, 185, 202, 206, 220, 221 and 254.

Examples of the cyan colorant may include: copper phthalocyanine compounds and derivatives thereof, anthraquinone compounds. Preferred specific examples thereof may include: C.I. Pigment Blue 1, 7, 15, 15:1, 15:2, 15:3, 15:4, 60, 62 and 66.

These colorants may be used singly, in mixture or in a state of solid solution. The colorant may be selected in view of the hue angle, saturation, brightness, weatherability, transparency when used in an OHP sheet and dispersibility in the toner. The colorant may be added in 1–20 wt. parts per 100 wt. parts of the binder resin.

The inorganic fine particles (a) may preferably comprise silica, alumina, titania or a composite oxide of these in view of the charge stability, developing performance, flowability and storability of the resultant non-magnetic toner. It is further preferred to use silica. The silica may be either of the so-called dry-process silica or fumed silica formed by vapor-phase oxidation of a silicon halide or alkoxide and the wet-process silica formed from silicates, silicon alkoxide or water glass. However, the dry-process silica is preferred because of fewer silanol groups at the surface and inside thereof and also fewer production residues, such as $Na_2O_3$ and $SO_3^{2-}$. The dry process silica can be in the form of composite metal oxide powder with other metal oxide for example be using another metal halide, such as aluminum chloride or titanium chloride, together with silicon halide in the production process. Silica fine powder herein may include such composite metal oxide powder.

The inorganic fine particles (a) may preferably have a BET specific surface area as measured according to the BET method by using nitrogen as adsorbate gas of at least 30 $m^2/g$, particularly 50–400 $m^2/g$ so as to provide good results. It is suitable to use 0.1–8 wt. parts, preferably 0.5–5 wt. parts, further preferably 1.0–3.0 wt. parts, per 100 wt. parts of the non-magnetic toner particles.

The inorganic fine particles (a) may preferably have a number-average primary particle size of at most 50 nm, more preferably 1–30 nm.

The number-average primary particle size of the inorganic fine particles (a) referred to herein are based on values obtained by observing sample particles at a magnification of 100,000 through an electron microscope and taking 100 particles each having a size of 1 nm or larger to calculate an average of the longer-axis diameters of the 100 particles.

It is also preferred that the inorganic fine particles (a) have been treated, as desired, with an agent, such as silicone varnish, silicone varnish having various functional groups, silicone oil, silicone oil having various functional groups, silane coupling agent, silane coupling agent having various functional groups, other organosilicon compounds, or organotitanium compounds for the purpose of hydrophobization and/or chargeability control. The treating agent can be used in mixture of different types.

In order to provide a toner exhibiting a high chargeability, a lower consumption and a high transferability, it is further preferred to use the inorganic fine particles (a) which have been treated at least with silicone oil.

The non-magnetic toner according to the present invention includes inorganic or organic spherical fine particles (b) having a shape close to a true sphere and a number-average primary particle size of 50–1000 nm, preferably 70–900 nm, in addition to the inorganic fine particles (a) in order to improve the transferability and/or the simultaneous development and cleaning performance. It is preferred to use, e.g., spherical silica particles or spherical resin particles. The spherical fine particles (b) may preferably have a BET specific surface area of at most 30 $m^2/g$.

The spherical fine particles (b) may have a surface area-based sphericity $\psi$ of 0.91–1.00 according to the following definition:

$\psi$=[geometrical specific surface area ($m^2/g$) based on an assumption that the spherical fine particles (b) are in the form of true spheres]/[actually measured BET specific surface area ($m^2/g$) of the spherical fine particles (b)].

The values of BET specific surface area ($m^2/g$) of spherical fine particles (b) for calculation of $\psi$ referred to herein are based on measurement by using a specific surface area meter ("Autosorb 1", available from QUANTACHROME Co.) performed in the following manner.

Ca. 0.3 g of spherical fine particles (b) are weighed into a cell, subjected to evacuation at a temperature of 40° C. and a vacuum of $1.0\times10^{-3}$ mmHg for at least 1 hour, and then subjected to nitrogen adsorption, while being cooled at liquid nitrogen temperature, for specific surface area determination according to the BET multi-point method.

The geometrical specific surface area ($m^2/g$) on an assumption that the spherical fine particles (b) are in the form of true spheres, may be measured in the following manner. Sample spherical fine particles (b) are photographed at a magnification of 10,000 through an electron microscope, and images of 100 particles each having a particle size of at least 10 nm are selected at random to obtain an average of the longer-axis diameters of the 100 particles. Then, a spherical fine particle (b) is assumed to be a true sphere having a radius r (=½×the average longer-axis diameter) so that its surface area is calculated as $4\pi r^2$ ($m^2$) and its volume is calculated as $4\pi r^3/3$ ($m^3$). Then, by using a density $d_b$ ($g/m^3$) of the spherical fine particles (b) separately measured, the ssumed geometrical specific surface area can be calculated as $4\pi r^2/(d_b\times4\pi r^3/3)=3/(d_b\times r)$.

In the present invention, as a result of external addition in combination of the spherical fine particles (b) having a surface area-based sphericity $\psi$ of 0.91–1.00 and the inorganic fine particles (a), it is possible to retain a satisfactory simultaneous development and cleaning performance for a long period. The spherical fine particles (b) may preferably be added in 0.01–1.0 wt. parts, more preferably 0.03–0.8 wt. parts, per 100 wt. parts of the non-magnetic toner particles.

In the case where the spherical fine particles (b) are constituted as spherical resin particles, the resin particles may be produced through, e.g., emulsion polymerization or spray drying under controlled conditions. A good effect may be attained by using resin particles having a glass transition point of at least 75° C., more preferably 80–150° C., e.g., obtained by emulsion polymerization of styrene monomer, or methyl methacrylate monomer.

The toner used in the present invention can contain other additives within an extent of not substantially adversely affecting the present invention. Examples of such additives may include: lubricant powders, such as polytetrafluoroethylene powder, zinc stearate powder and polyvinylidene fluoride powder; abrasives, such as cerium oxide powder, silicon carbide powder, strontium titanate powder, and calcium titanate powder; anti-caking agents; and electroconductivity-imparting agents, such as carbon black powder, zinc oxide powder, and tin oxide powder.

The non-magnetic toner particles used in the present invention may be produced in the following manner. A first process may include the steps of blending the ingredients, such as a binder resin, wax, metal salt or metal complex, pigment or dye as a colorant, and other additives, such as a charge control agent, as desired, by means of a blender, such as a Henschel mixer or a ball mill; melt-kneading the blend by hot kneading means, such as hot rollers, a kneader or an extruder, to well disperse or dissolve the metal compound, pigment or dye, etc. within the melt-kneaded resin; pulverizing the kneaded product after cooling and solidification; and classifying the pulverized product in a classification step including a final stage wherein it is preferred to use a multi-division classifier in view of production efficiency.

The resultant toner particles may preferably be subjected to a surface treatment for providing the prescribed shape factors SF-1 and SF-2. The surface treatment may be effected, e.g., by a hot water process of dispersing and heating the pulverized toner particles in hot water, a thermal treatment process of passing the toner particles in a hot gas stream, and a mechanical impact process of applying a mechanical energy to the toner particles. As a type of the mechanical impact process, it is preferred to adopt a thermo-mechanical impact process of adopting a treatment temperature close to the glass transition point Tg of the toner particles, more specifically in a range of Tg±10° C., from the view point of agglomeration prevention and productivity. A treatment temperature in a range of the glass transition point Tg±5° C. is further preferred and effective for reducing the surface pores or unevenness having a radius of 10 nm or larger and have the inorganic fine particles (a) function more effectively to provide an improved transfer-efficiency.

In the present invention, it is preferred to use an electrostatic latent image-bearing member having a surface provided with releasability. As a result, it becomes possible to remarkably reduce the amount of transfer residual toner, thereby essentially obviating a negative ghost image caused by light interruption due to transfer residual toner, and also to provide an improved efficiency of recovering the transfer residual toner in the development region during development, thereby well preventing a positive ghost image.

Now, the mechanism of occurrence of ghost images will be described.

The light interruption due to transfer residual toner particularly in the case where the surface of an electrostatic latent image-bearing member is repetitively used for providing an image on one sheet of transfer(-receiving) material (or recording paper). In the case where one circumference of the image-bearing member is shorter than the length in movement direction of one transfer material, the image-bearing member surface has to be subjected to a sequence of charging-exposure-development while the transfer residual toner is present thereon, so that the potential on the image-bearing member is not sufficiently lowered during exposure at the portion where the transfer residual toner is present, thereby resulting in an insufficient development contrast. As a result, in an image forming method using the reversal development mode, a negative ghost having a lower density than the surrounding portion appears in the resultant image.

On the other hand, in the case where the transfer residual toner is not cleaned sufficiently during the development step, a toner is deposited for development on the image-bearing member carrying the transfer residual toner to result in a positive ghost having a higher density than the surrounding.

In the image forming method according to the present invention, it is possible to well prevent the above-mentioned ghost images.

The present invention is particularly effective in the case where the electrostatic latent image-bearing member is composed principally of a polymer binder. Such an image-bearing member may for example be provided if a resinous protective layer is formed on an inorganic photosensitive member of, e.g., selenium or amorphous silicon, or if a function separation-type organic photosensitive member is provided with a charge transport layer comprising a charge transportation substance and a resin as a surface layer or if a resinous protective layer as described above is further provided thereon. Such a surface layer may be provided with a releasability by (1) using a resin having a low surface energy for constituting the surface layer, (2) incorporating an additive for imparting water-repellency or lipophilicity, or (3) dispersing a powder of a material having a high releasability. The condition (1) may be accomplished by using a resin having a fluorine-containing group or a silicon-containing group introduced into its structure. The condition (2) may be accomplished by incorporating a surfactant as the additive. The condition (3) may be accomplished by using a powder of a fluorine-containing compound, such as polytetrafluoroethylene, polyvinylidene fluoride or fluorinated carbon. Among these, polytetrafluoroethylene is particularly suitable. In the present invention, it is particularly preferred to disperse a powder of a releasable substance, such as a fluorine-containing resin, in the utmost surface layer.

By using such measures, it becomes possible to provide the electrostatic latent image-bearing member with a surface showing a contact angle with water of at least 85 deg., preferably at least 90 deg. Below 85 deg., the toner and the toner-carrying member are liable to be deteriorated during a long period of use.

Such a releasability-imparting powder may be incorporated in the surface layer by forming an utmost surface layer comprising a binder resin and such a powder dispersed therein on an already formed image-bearing member or by dispersing such a powder in the uppermost resinous layer of an organic image-bearing member without providing an additional surface layer.

Such a releasability-imparting powder may preferably be added into the surface layer in an amount of 1–60 wt. %, further preferably 2–50 wt. %, of the total weight of the surface layer. Below 1 wt. %, the residual toner-reducing effect is insufficient and the cleaning performance-improving effect is insufficient, so that the ghost preventing effect is liable to be insufficient. Above 60 wt. %, the surface layer is liable to lower its strength, and the incident light quantity to the photosensitive layer is liable to be lowered. The particles may preferably have a particle size of at most 1 μm, more preferably at most 0.5 μm, in view of image qualities. Above 1 μm, the clarity of line images is liable to be impaired due to scattering of the incident light.

The present invention is particularly effective in the case of using a direct-charging or contact-charging system wherein a charging member is caused to directly contact or abut the image-bearing member. If an increased amount of toner is left after the transfer step, the residual toner is attached to the direct charging member to cause a charging failure in the subsequent charging step. Accordingly, the necessity of reducing the residual toner amount is more intense than in the corona charging system wherein the charging means is free from contact with the image-bearing member.

According to the present invention, it is possible to provide an image forming method using the simultaneous development and cleaning system and capable of providing graphic images with an excellent gradation characteristic while not impairing individual dot reproducibility.

Figure 14:
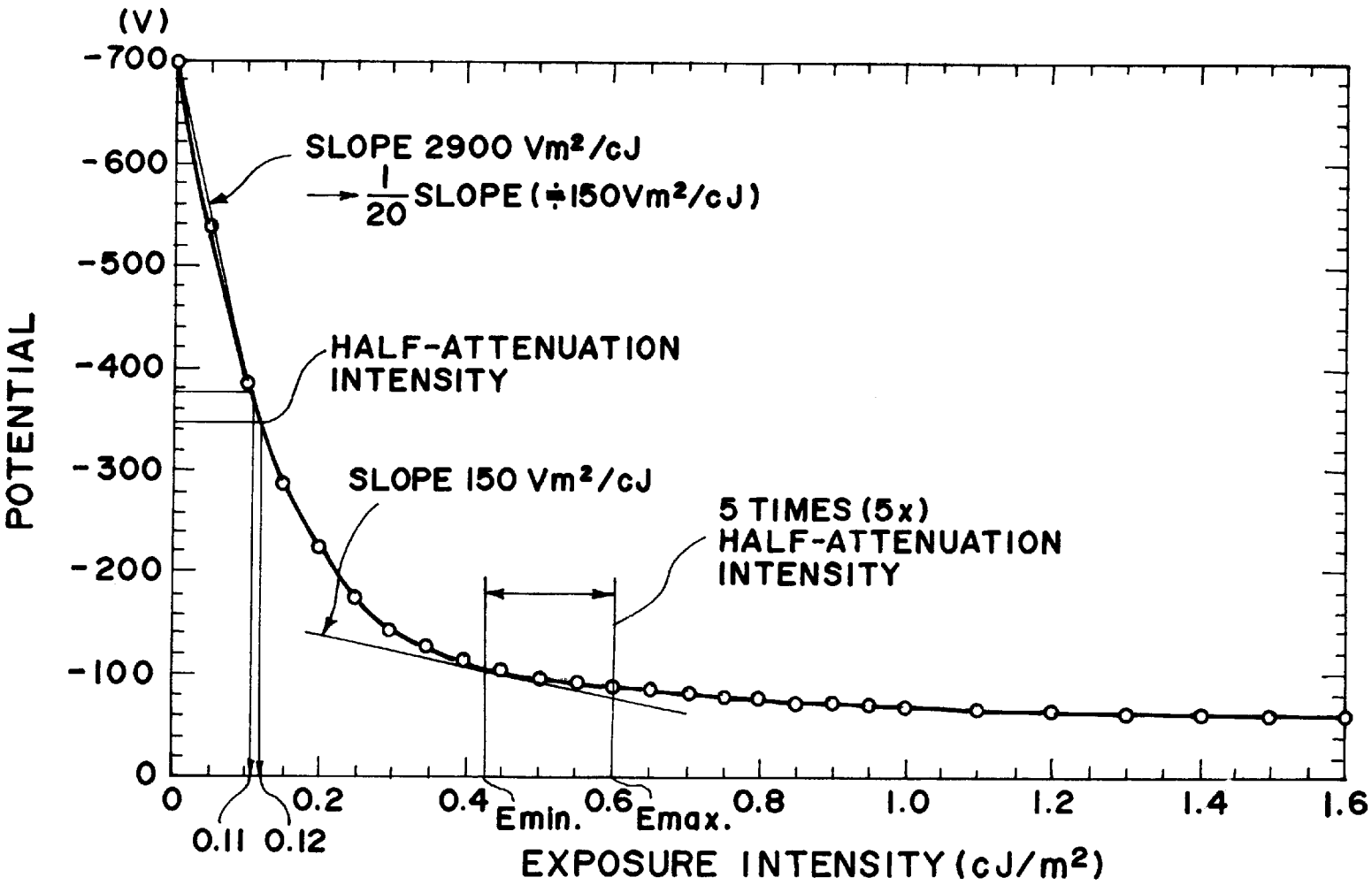
FIG. 14 is a graph showing a relationship between exposure intensity and potential of a photosensitive member.

As a result of our extensive study, it has been found possible to provide graphic images with good individual dot reproducibility and a rich gradation characteristic according to the simultaneous development and cleaning scheme if a latent image is formed at an exposure intensity (i.e., an exposure quantity per area) which is at least a minimum exposure intensity Emin. and below a maximum exposure intensity Emax. determined on a surface potential-exposure intensity characteristic curve of a photosensitive member (preferably obtained under process conditions identical to those adopted in an actual image forming apparatus) as shown in FIG. 14. Emin. is determined on such a surface potential-exposure intensity characteristic curve of the photosensitive member by determining a first slope S1of a straight line connecting a point giving a dark part potential Vd and a point giving a value of (Vd+a residual potential Vr)/2, determining a contact point between a tangent line having a slope of S1/20 and the surface potential-exposure intensity characteristic curve and determining the minimum exposure intensity as an exposure intensity at the contact point. On the other hand, Emax is determined as 5 times a half-attenuation (exposure) intensity on the surface potential-exposure intensity characteristic curve.

The exposure means is not particularly limited but a laser may preferably be used in view of a small spot diameter size and a power. If the exposure intensity is below the above-specified minimum exposure intensity Emin., the resultant image is liable to be accompanied with thinned or scratchy lines and also accompanied with a ghost image. In case where the exposure intensity is 5 times the half attenuation intensity or above, ghost images may not occur but individual dots are liable to be deformed to cause resolution failure and a lower gradation characteristic.

From the viewpoint of apparatus designing, a larger ratio of exposure range (Emax.−Emin.)/the half-attenuation exposure intensity provides a larger latitude for exposure selection. The ratio may preferably be at least 0.7, more preferably at least 1.0.

In the present invention, a further better individual dot reproducibility may be obtained when the half-attenuation exposure intensity of the photosensitive member is at most 0.5 $cJ/cm^2$. This is because such a photosensitive member having a relatively high sensitivity shows a smaller potential fluctuation in response to light interruption with the transfer residual toner than in the case of using a photosensitive member having a relatively low sensitivity. A better result can be attained when the half-attenuation exposure intensity is at most 0.3 $cJ/m^2$.

A type of electrostatic latent image-bearing member preferably used in the present invention may have a structure as described below.

An electroconductive support may generally comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet or film, or an endless belt.

Between the electroconductive support and the photosensitive layer, it is possible to dispose an undercoating layer for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethylene-acrylic acid copolymer, polyvinyl butyral, phenolic resin, casein, polyamide, copolymer nylon, glue, gelatin, polyurethane, or aluminum oxide. The thickness may preferably be ca. 0.1–10 $\mu$m, particularly ca. 0.1–3 $\mu$m.

The photosensitive layer may comprise a single layer containing both a charge-generation substance and a charge-transporting substance, or a laminated structure including a charge generation layer containing a charger generation substance, and a charge transport layer containing a charge transporting substance, in lamination.

The charge generation layer may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as amorphous silicon, in the form of a dispersion in a film of an appropriate binder resin or a vapor deposition film thereof.

The binder may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–40 wt. %, of the charge generation layer. The charge generation layer may preferably have a thickness of at most 5 $\mu$m, preferably 0.05–2 $\mu$m.

The charge transport layer has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may preferably be 0.5–40 $\mu$m. Examples of the charge transporting substance may include: polycyclic aromatic compounds having in their main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide.

Examples of the binder resin for dissolving or dispersing therein the charge transporting substance may include: resins, such as polycarbonate resin, polyester resin, polystyrene resin, acrylic resins, and polyamide resins; and organic photoconductive polymers, such as poly-N-vinylcarbazole and polyvinyl-anthracene.

The photosensitive layer can be further coated with a protective layer comprising one or more species of a resin, such as polyester, polycarbonate, acrylic resin, epoxy resin, or phenolic resin together with its hardening agent, as desired.

Such a protective layer may further contain electroconductive fine conductive fine particles of metal or metal oxide, preferred examples of which may include ultrafine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in mixture of two or more species. The protective layer can further contain insulating fine particles. Such particles dispersed in the protective layer may preferably have a particle size smaller than the wavelength of light incident thereto so as to prevent scattering of the incident light due to the dispersed particles. More specifically, the electroconductive or insulating particles dispersed in the present invention may preferably have a particle size of at most 0.5 $\mu$m. The content thereof may preferably be 2–90 wt. %, further preferably 5–80 wt. %, of the total solid matter in the protective layer.

The protective layer may preferably have a thickness of 0.1–10 μm, more preferably 1–7 μm.

The above-mentioned layers may be formed, e.g., by spray coating, beam coating or dip coating.

In a preferred embodiment of the present invention, the development may be performed according to the reversal development scheme under a condition that the toner layer on the toner-carrying member and the photosensitive member surface contact each other at a position where they are close to each other.

In this instance, at the time of development or at the time of pre- or post-rotation before or after the development, a DC or AC bias voltage is applied to the photosensitive member by a charging member, etc., for a control such that the transfer residual toner on the photosensitive member can be recovered by the toner-carrying member of the developing apparatus. The DC bias component voltage at this time is controlled at a level intermediate the light-part potential and the dark-part potential.

At this time, it is important to control the charging polarity and charge amount of the toner on the photosensitive member in the respective steps of electrophotography. For example, in the case of a reversal development mode of using a negatively chargeable photosensitive member and a negatively chargeable toner in the present invention, the visualized toner image is transferred onto a transfer material supplied with a positive voltage. In this instance, depending on the kind (thickness, resistivity, dielectric constant, etc.) of the transfer material and a relationship with the image area, the charging polarity of the transfer residual toner can range widely from positive to negative. However, because of a negative charge for primarily charging the negatively chargeable photosensitive member, even when not only the photosensitive member surface but also the residual toner is positively charged after the transfer step, they can be uniformly charged negatively. As a result, the negatively charged residual toner at the light-potential part to be developed with a toner remains thereat, and the residual toner at the dark-potential part not to be developed with a toner is attracted to the toner carrying member, such as a developing sleeve under the action of a developing electric field, so that the residual toner does not remain at the dark-potential part on the photosensitive member.

It is also possible to use a method of applying a toner as a monocomponent-type developer onto an elastic roller surface, etc. and causing it to contact the photosensitive member surface. In this instance, the contact between the toner layer and the photosensitive member surface is important. In this instance, as the simultaneous developing and cleaning may be effected by an electric field acting between the photosensitive member and the elastic roller opposite thereto via the toner, it is necessary that the elastic roller surface or the proximity thereof has a potential and exerts an electric field across a narrow gap between the photosensitive member surface and the toner-carrying surface. For this purpose, it is also possible to use an elastic roller comprising an elastic rubber controlled to have a medium-level resistivity so as to retain an electric field while preventing conduction with the photosensitive member surface, or to form a thin insulating surface layer on the electroconductive roller. It is also possible to use an electroconductive resin sleeve formed by coating the side of an electroconductive roller facing the photosensitive member surface with an insulating layer or to use an insulating sleeve having an electroconductive layer on its side not facing the photosensitive member.

In the case of using a mono-component contact developing method, a sleeve or roller carrying a non-magnetic toner can rotate in a direction identical or opposite to the rotation direction of the photosensitive member at a position of contact or proximity therebetween. In the case of peripherally identical rotation direction, the carrying sleeve or roller may preferably rotate at a speed of 100% or more of the peripheral speed of the photosensitive member. Below 100%, the resultant image qualities are liable to be impaired. A higher peripheral speed provides a higher toner supply rate to the developing position and a higher frequency of attachment and detachment of the toner with respect to the latent image, thus increasing the repetition of peeling of unnecessary portion of toner from the toner and attachment of the toner onto a necessary part, to provide an image faithful to the latent image. In view of the simultaneous developing and cleaning performance, a higher peripheral speed ratio is preferred for convenience of residual toner recovery as it is possible to enjoy an effect of physically peeling the attached residual toner from the photosensitive member surface by the peripheral speed difference and recovering the peeled toner by an electric field.

For avoiding environmental pollution, it is preferred to use a charging member in contact with an electrostatic latent image-bearing member, such as a photosensitive member, so as to avoid generation of ozone.

Some embodiments of the image forming method according to the present invention will now be described with reference to drawings.

Figure 1:
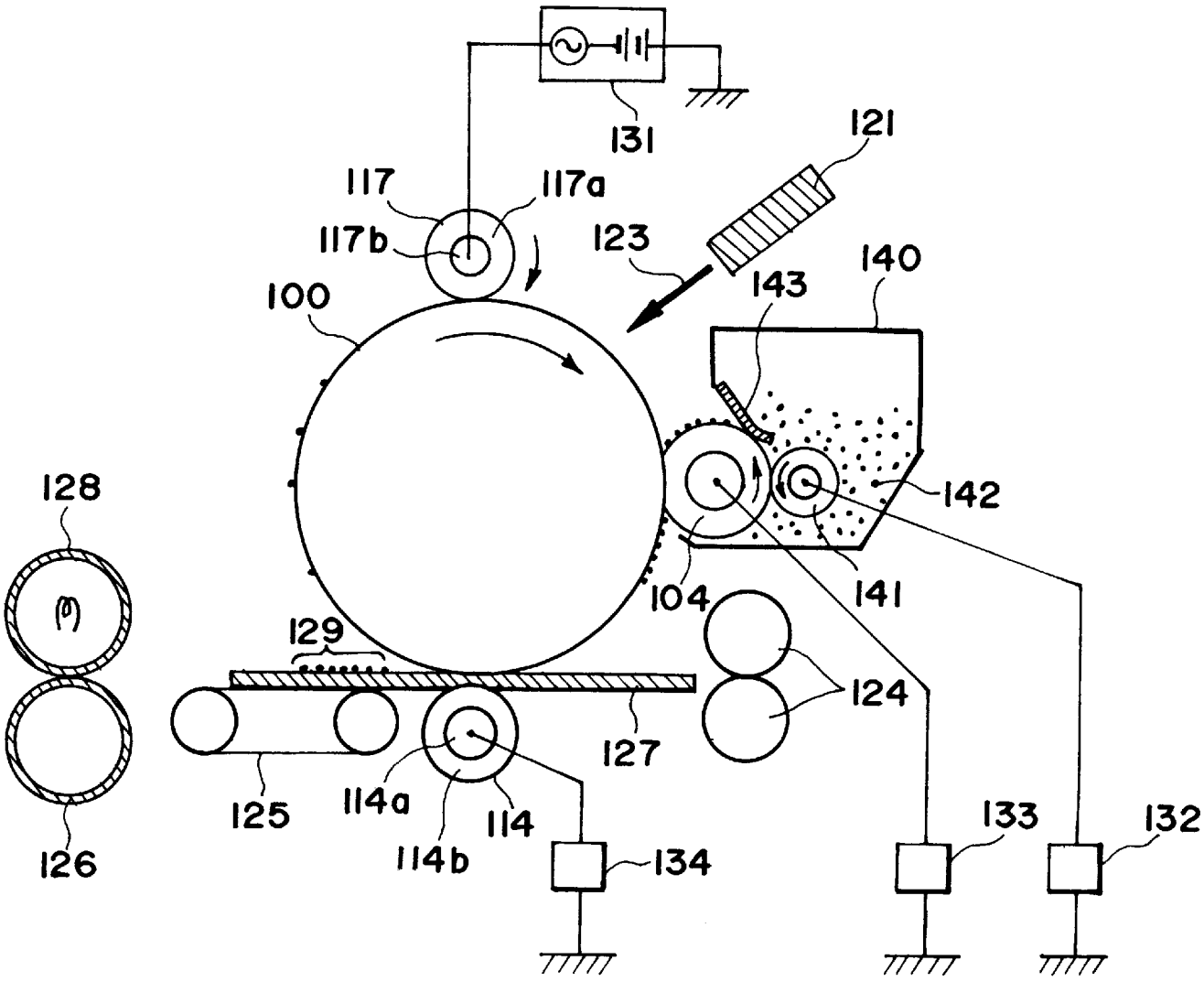
FIG. 1 is a schematic illustration of an image forming apparatus for practicing an embodiment of the image forming method according to the invention.

Referring to FIG. 1, an image forming system includes a photosensitive drum 100, around which are disposed a primary charging roller 117 as contact charging means, a developing device 140 as a developing means, a transfer charging roller 114 and register rollers 124. The photosensitive drum 100 is charged at, e.g., −700 volts, by the primary charging roller 117, which is supplied with a DC voltage of, e.g., −1350 volts by a bias voltage application means 131. The charged photosensitive drum 100 is exposed to laser light 123 from a laser 121 to form a digital electrostatic latent image thereon. The electrostatic latent image on the photosensitive drum is developed with a non-magnetic mono-component toner from the developing device 140 to form a toner image thereon, which is transferred to a transfer(-receiving) material (such as plain paper or an OHP transparent film) under the action of a transfer roller 114 abutted to the photosensitive drum via the transfer material 127 and supplied with a bias voltage from a bias application means 134. The transfer material carrying the toner image 129 is conveyed by a conveyer belt 125 to a hot pressure fixation device comprising a heating roller 128 and a pressure roller 126, where the toner image is fixed onto the transfer material.

The charging roller 117 basically comprises a central metal core 117*b* and an electroconductive elastic layer 117*a* coating the metal core 117 to form an outer peripheral layer. The charging roller 117 is pressed against the photosensitive drum 100 at a prescribed pressure and rotated in a counter direction with the photosensitive member as indicated by arrows.

Preferred process conditions for the charging roller 117 may include a roller abutting pressure of 5–500 g/cm, and an AC-superposed DC voltage including an AC voltage=0.5–5 kVpp, an AC frequency=50 Hz–5 kHz and a DC voltage of ±0.02–±1.5 kV, or a DC voltage alone of ±0.2–±1.5 kV.

The charging roller as a contact charging means may preferably comprise an electroconductive rubber and may be coated with a releasable surface film comprising, e.g., a nylon resin, PVDF (polyvinylidene fluoride) or PVDC (polyvinylidene chloride).

As shown in FIG. 1 (and also in FIG. 2 in an enlarged form), a toner-carrying member (hereinafter called a "developing sleeve") 104 of the developing device 140 is disposed in contact with the photosensitive drum 100. The developing sleeve 104 is in the form of an elastic roller comprising a metal core 104*a* supplied with a bias voltage from a bias application means 133 and an elastic layer 104*b*. The developing device 140 is provided therein with a toner application roller 141 comprising a metal core 141*a* supplied with a bias voltage from a bias application means 132 and an elastic layer 141*b*. The amount of the toner attached to the developing sleeve 104 and conveyed to the development region is controlled by abutting pressure at which a toner regulating blade 143 is abutted against the developing sleeve 104. In the developing region, the toner 102 on the developing sleeve 104 is transferred onto the photosensitive drum 100 corresponding to the electrostatic latent image thereon to form a toner image under the action of a developing bias voltage comprising at least a DC voltage applied to the sleeve 104.

For accomplishing simultaneous development and cleaning, preferred conditions may include: for a light-part potential of 0–250 volts and a dark-part potential of 100–300 volts on the photosensitive drum 100, a bias voltage from the bias application means 132 of 100–900 volts, and a bias voltage from the bias application means 133 of 100–900 volts. It is further preferred that the bias voltage from the means 132 is larger by 10–400 volts than that from the means 133 so as to smoothly effect the supply of the non-magnetic toner 142 onto the developing sleeve 104 and peeling-off of the non-magnetic toner from the developing sleeve 104. It is preferred that the toner application roller 141 is rotated in a counter direction as indicated with that of the developing sleeve 104 so as to smoothly effect the supply and peeling-off of the non-magnetic toner.

The toner image formed on the photosensitive drum 100 is transferred onto the transfer material 127 by transfer means via or not via an intermediate transfer member (e.g., drum or belt, not shown). FIG. 1 shows the case wherein the toner image is transferred onto the transfer material 127 not via such an intermediate transfer embodiment. In the transfer step shown in the embodiment of FIG. 1, the toner image transfer is performed in a contact transfer mode.

In the contact transfer step, the toner image on the photosensitive drum 100 (electrostatic latent image-bearing member) is electrostatically transferred onto the transfer material 127 by abutting the transfer roller 114 (as transfer means) against the photosensitive drum 100 via the transfer material 127. The abutting pressure of the transfer roller may preferably be at least 2.9 N/m (3 g/cm), more preferably at least 19.6 N/m (20 g/cm), in terms of a linear pressure. If the linear abutting pressure is below 2.1 N/m (3 g/cm), the transfer material is liable to cause a conveyance deviation or a transfer failure. The contact transfer means may be a transfer roller or a transfer belt.

In the transfer step shown in FIG. 1 (or FIG. 4), the transfer means is in the form of a transfer roller 114 comprising a metal core 114*a* supplied with a bias voltage from a bias application means 134 and an electroconductive elastic layer 114*b*.

The electroconductive elastic layer may preferably comprise an elastic material, such as urethane rubber or EPDM with an electroconductivity-imparting agent, such as carbon, dispersed therein so as to have a volume resistivity of $10^6$–$10^{10}$ ohm.cm.

Such a contact transfer means is particularly effective when used in an image forming apparatus including a photosensitive drum having a small diameter of at most 50 mm. This is because such a small-diameter photosensitive drum has a large curvature (small curvature radius) for an identical linear pressure, so that a pressure concentration can be easily accomplished at the abutting portion. Similar effectiveness may be exhibited in an image forming apparatus including a belt-form photosensitive member having a curvature radius of at most 25 mm at the transfer position.

In the image forming method according to the present invention, a good transfer efficiency can be attained by using a non-magnetic toner including non-magnetic toner particles having a shape factor SF-1 of 120–160, a shape factor SF-2 of 115–140 and a weight-average particle size of 4–9 $\mu$m; together with inorganic fine particles (a) having a number-average primary particle size of at most 50 nm and spherical fine particles (b) having a number-average primary particle size of 50–1000 nm and a surface area-based sphericity $\psi$ of 0.91–1.00, respectively externally added to the non-magnetic toner particles.

Transfer residual toner after the transfer step is conveyed to the position of the charging roller 117, and the toner having slipped by the roller 117 is recovered into the developing device 140 by cleaning simultaneous with development by the developing device 140. In this instance, owing to the combined external addition of the inorganic fine particles (a) and the spherical fine particles (b), the development of an electrostatic latent image on and the recovery of the transfer residual toner from the photosensitive drum 100 are simultaneously smoothly performed under the condition where the non-magnetic toner layer on the rotating developing sleeve 104 is pressed against the rotating photosensitive drum 100, thereby also exhibiting an excellent continuous image forming characteristic on a large number of sheets.

The present invention is also effectively applicable to an image forming system wherein a photosensitive member having a charge injection layer is used in combination with a contact charging member and is subjected to the simultaneous development and cleaning scheme. A preferred embodiment thereof will be described with reference to FIGS. 5 through 8.

Figure 5:
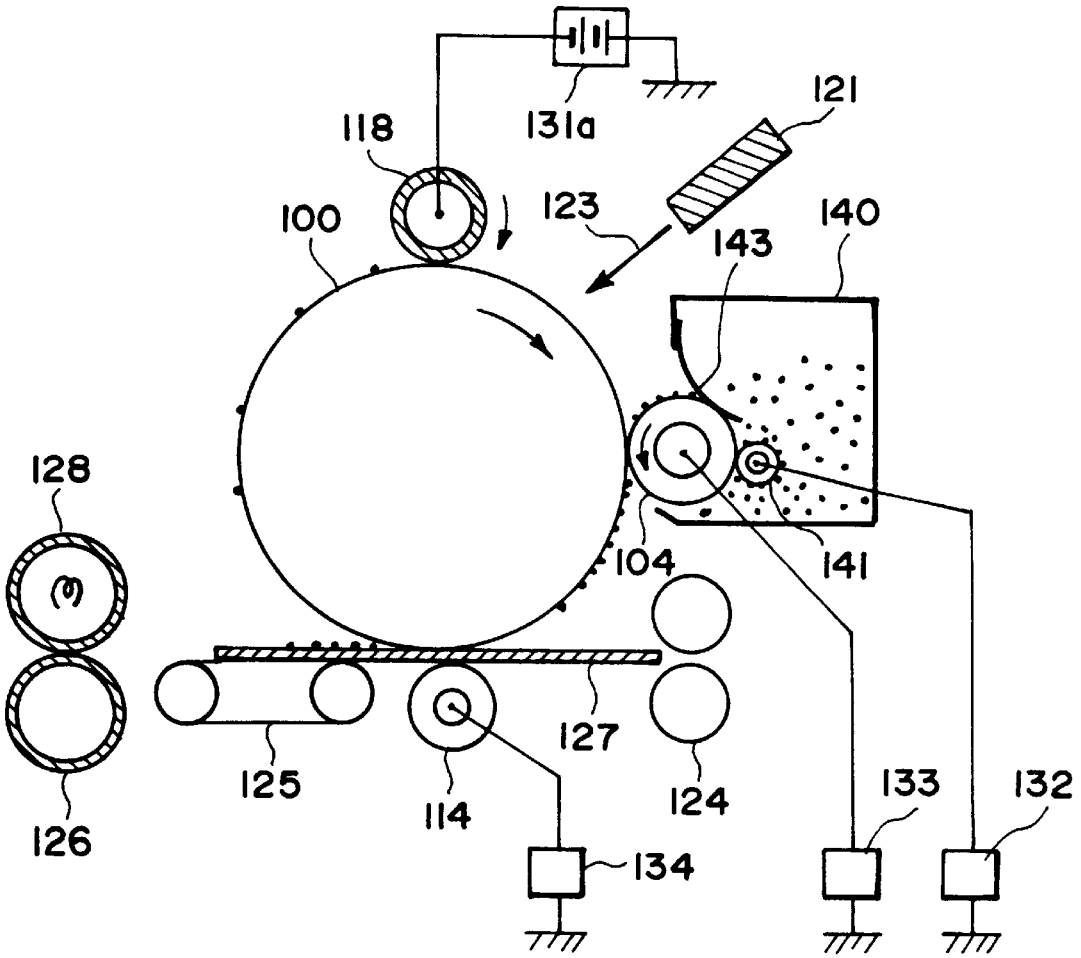
FIG. 5 is a schematic illustration for practicing another embodiment of the image forming method according to the invention.
Figure 8:
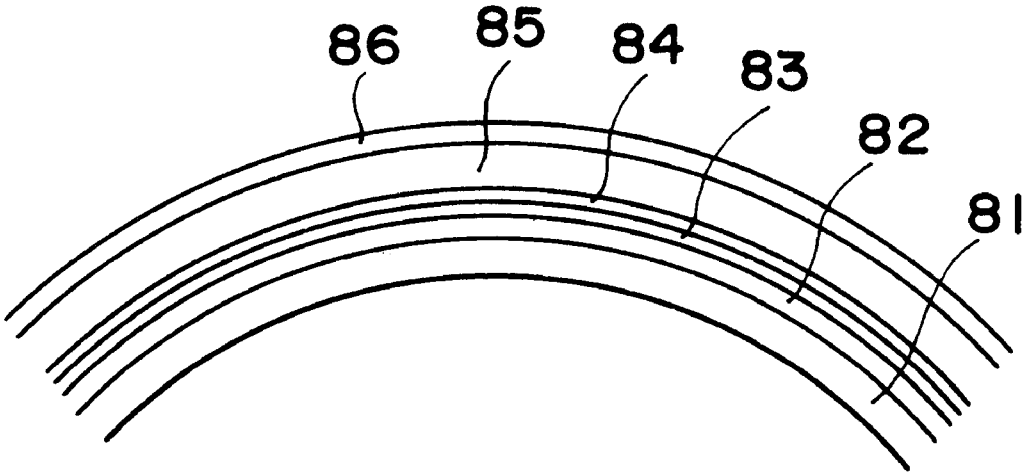
FIG. 8 is an enlarged sectional illustration of a laminate structure of a photosensitive member used in the image forming apparatus of FIG. 5.

An image forming system shown in FIG. 5 includes a photosensitive drum (photosensitive member) 100 having a surface charge injection layer, e.g., in a laminar structure as shown in FIG. 8 including an aluminum (Al) substrate 81, an electroconductive coating layer 82, an undercoating layer 83, a charge generation layer 84, a charge transport layer 85 and a surface charge injection layer 86. The photosensitive drum 100 is charged with a contact charging member supplied with a bias voltage. The contact charging member can be a blade-shaped member but may preferably be a rotatable member, such as a rotatable roller member, a rotatable brush roller member or a rotatable belt member, so that it can have an appropriately set peripheral speed relative to the photosensitive drum 100 for realizing a charging step suitable for the simultaneous development and cleaning system (or cleaner-less system). FIG. 5 shows an example of such a contact charging member in the form of a magnetic brush roller 118 supplied with a bias voltage from a bias application means 131*a*.

Also in the image forming system shown in FIG. 5, it is preferred to provide the photosensitive member surface with a releasability showing a contact angle with water of at least 85 deg, more preferably 90 deg. so as to improve the transferability of the toner in the transfer step, thereby remarkably reducing the amount of transfer residual toner. As a result, the light interruption due to transfer residual toner can be almost removed to substantially prevent the negative ghost image. Further, the residual toner cleaning effect in the developing step is also enhanced, thus being able to prevent the positive ghost image.

Such a photosensitive member having a charge injection layer may be uniformly charged to a polarity of the transfer residual toner by charging due to a charge injection at a good efficiency by application of a low DC voltage closer to the charged potential of the photosensitive member (compared with the charging by DC discharge), so that excessive charge of the transfer residual toner can be prevented. As a result, it becomes possible to further effectively suppress the charge-up (i.e., excessive charge) of toner due to recovery of the transfer residual toner onto the toner-carrying member during the development, and the broadening of the toner charge distribution.

It is further preferred to effect a charging step by causing a contact charging member having a volume resistivity of $10^4$–$10^{10}$ ohm.cm as measured according to a dynamic resistivity measurement method in contact with a rotating conductive substrate in an electric field of from 20 to V1 (volt/cm) to abut on a photosensitive member having a charge injection layer having a volume resistivity of $1\times10^8$–$1\times10^{15}$ ohm.cm, wherein V1 denotes a larger one of electric fields (V−VD)/d and V/d, V denotes a voltage applied to the contact charging member, VD denotes a potential of the photosensitive member immediately before contact with the contact charging member, and d denotes a gap between a voltage supplied part of the contact charging member and the photosensitive member.

By using such a contact charging member and a charging member in combination, it becomes possible to realize a low charge initiation voltage Vh and charge the photosensitive member to a potential which is ca. 90% or higher of the voltage applied to the charging member. For example, when a contact charging member is supplied with a DC voltage of 100–2000 volts, in terms of an absolute value, a photosensitive member having a charge injection layer can be charged to a potential which is 80% or higher, further 90% or higher, of the applied voltage. In contrast thereto, according to the conventional charging method utilizing discharge, a photosensitive member can only be charged to a potential which is nearly 0 at an applied voltage of up to 640 volts or a difference of the applied voltage minus 640 volts at an applied voltage in excess of 640 volts.

If the charge injection layer has a volume resistivity of $1\times10^8$–$1\times10^{15}$ ohm.cm, it is possible to prevent the image flow in a high-humidity environment and effect an injection charging by the contact charging member. It is further preferred that the charge injection layer has a volume resistivity of $1\times10^{11}$–$1\times10^{14}$ ohm.cm, particularly $1\times10^{12}$–$1\times10^{14}$ ohm.cm.

The charge injection layer may preferably be formed as a layer of binder resin containing electroconductive particles dispersed therein. Such a conductive particles-dispersed resin layer may be formed by an appropriate coating method, such as dipping, spraying, roller coating or beam coating. Further the charge injection layer can also be formed with a mixture or copolymer of an insulating binder resin and a light-transmissive resin having a high ion-conductivity, or a photoconductive resin having a medium conductivity alone. In order to constitute the conductive particle-dispersed resin layer, the electroconductive particles may preferably be added in an amount of 2–250 wt. parts, more preferably 2–190 wt. parts, per 100 wt. parts of the binder resin. Below 2 wt. parts, it becomes difficult to obtain a desired volume resistivity. In excess of 250 wt. parts, the resultant charge injection layer is caused to have a lower film strength and is therefore liable to be worn out by scraping, thus resulting in a short life of the photosensitive member. Further, as the resistance is lowered, the latent image potential is liable to be flowed to result in inferior images.

The binder resin of the charge injection layer can be identical to those of lower layers, but, in this case, the charge transport layer is liable to be disturbed during the application of the charge injection layer, so that a particular care has to be exercised in selection of the coating method.

The charge injection layer may preferably further contain lubricant particles, so that a contact (charging) nip between the photosensitive member and the charging member at the time of charging becomes enlarged thereby due to a lowered friction therebetween, thus providing an improved charging performance. The lubricant powder may preferably comprise a fluorine-containing resin, silicone resin or polyolefin resin having a low critical surface tension. Polytetrafluoroethylene (PTFE) resin is further preferred. In this instance, the lubricant powder may be added in 2–50 wt. %, preferably 5–40 wt. %, of the binder resin. Below 2 wt. %, the lubricant is insufficient, so that the improvement in charging performance is insufficient. Above 50 wt. %, the image resolution and the sensitively of the photosensitive member are remarkably lowered.

The charge injection layer may preferably have a thickness of 0.1–10 $\mu$m, particularly 1–7 $\mu$m.

It is preferred to effect a charge injection to a photosensitive member having a medium level of surface resistivity by a medium-resistivity contact charging member. It is further preferred to inject charges into electroconductive particles dispersed in a light-transmissive insulating binder resin of the charge injection layer rather than injecting charges into a trap potential level of a material constituting the surface of the photosensitive member.

Theoretically, it is assumed that a charge is injected by a contact charging member to minute capacitors formed by sandwiching the charge transport layer as a dielectric member between electrodes comprising the electroconductive substrate (usually Al) and each electroconductive particle in the charge injection layer. In this instance, the electroconductive particles are mutually electrically independent and each constitute a kind of minute floating electrode. As a result, the photosensitive member surface macroscopically appears to be charged at a uniform potential but actually such a state is formed that the photosensitive member is surfaced with a large number of charged minute electroconductive particles. Accordingly, when the photosensitive member is subjected to imagewise exposure with laser light, an electrostatic latent image can be retained by electrically independent minute electroconductive particles.

As a result, improved charge-injection performance and charge retention characteristic may be attained by substituting electroconductive fine particles for trap energy levels which are scarcely present in a conventional photosensitive member surface.

The volume resistivity values of the charge injection layer described herein are based on values measured according to a method wherein a charge injection layer is formed on a conductive film (Au)-deposited PET film and subjected to measurement of a volume resistivity by using a volume resistivity measurement apparatus ("4140B pAMATER", available from Hewlett-Packard Co.) under application of a voltage of 100 volts in an environment of 23° C. and 65% RH.

Figure 6:
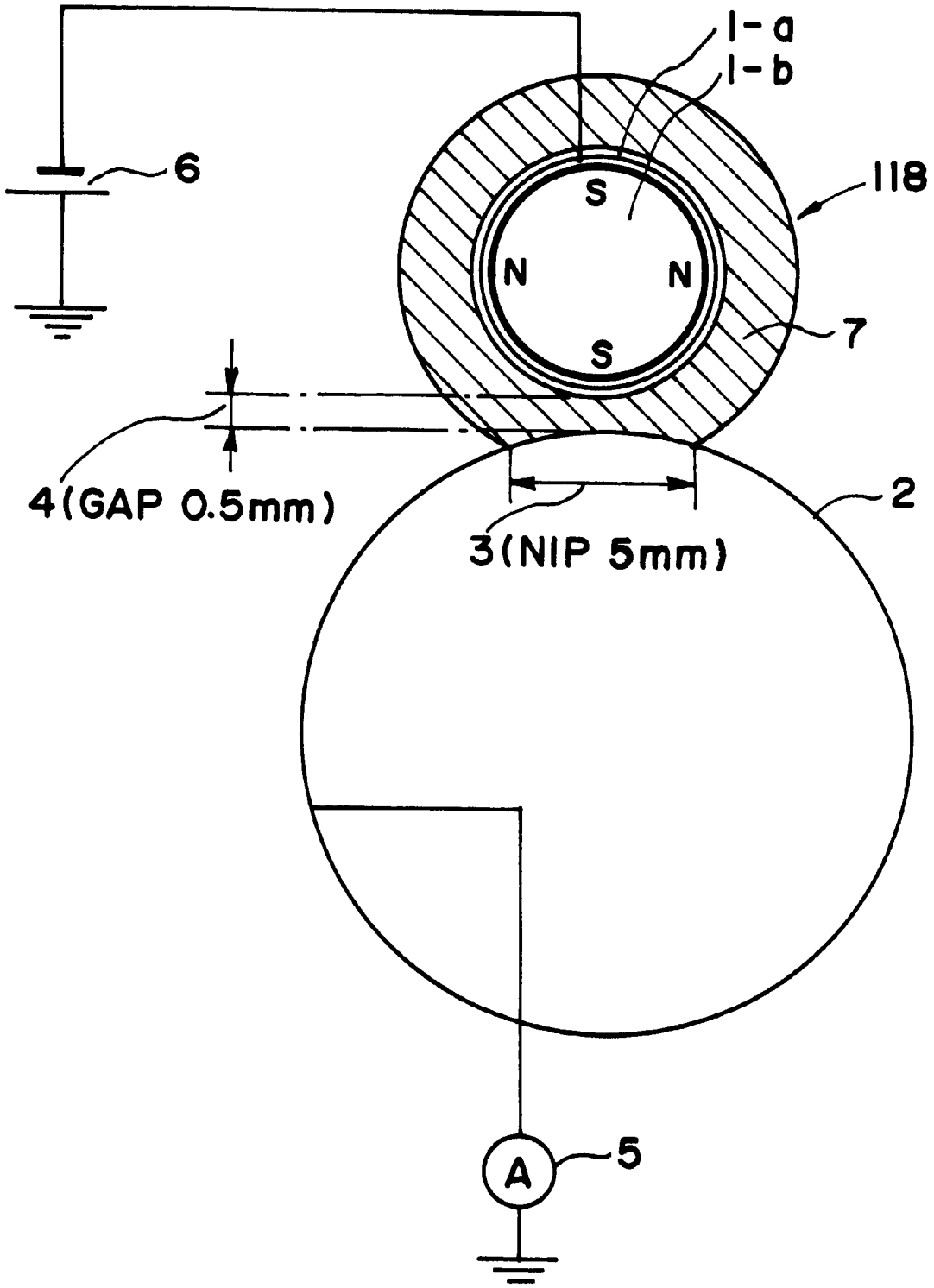
FIG. 6 is an illustration of an apparatus for measuring a resistivity in operation of a contact charging member.

The dynamic resistivity measurement method for a contact charging member will now be described with reference to FIG. 6, wherein the contact charging member comprises a charging roller means 118 including a magnetic brush composed of magnetic particles. The measurement may be performed in an environment of temperature 23° C. and humidity 65% RH Referring to FIG. 6, with respect to a rotatable aluminum drum (electroconductive substrate) 2, a rotatable charging roller means 118 is disposed so that its sleeve or retention member 1-*a* (enclosing a fixed magnet 1*b* therein) is positioned with a gap 4 (of ca. 0.5 mm) from the drum 2 and coated with a magnetic brush 7 of magnetic particles providing a contact nip 3 (of ca. 5 mm) with the drum 2. Then, the charging roller means 118 and the aluminum drum 2 (comparable to a photosensitive member) are rotated in directions and at speeds identical to those in an actual image forming operation while applying a DC voltage from a DC supply 6 to the charging means 118, thereby measuring a current actually passing through the system by an ammeter 5 to calculate the resistance, from which a dynamic resistivity (volume resistivity) is calculated based on the gap 4, the nip 3 and an axial length (width) along which the magnetic particles are in contact with the aluminum drum.

The resistivity of a charging member generally shows some applied electric field-dependence, i.e., varies to some extent with a change in electric applied to the charging member such that it becomes higher at a higher electric field and lower at a lower electric field.

In the case of charging the photosensitive member by charge injection, when the surface to be charged of the photosensitive member enters a nip region between the photosensitive member and the charging member, a large voltage difference is present between the potential of the photosensitive member before the entrance and the voltage applied to the charging member, so that the charging member is subjected to a high electric field. However, as the photosensitive member passes through the nip region, a charge is injected into the photosensitive member to gradually charge the photosensitive member within the nip region. As a result, the potential on the photosensitive member gradually approaches the applied voltage of the charging member, so that the applied electric field for the charging member is lowered. In other words, the electric field applied to the charging member in the step of charging the photosensitive member is larger at an upstream side and lower at a downstream side, respectively, of the nip region.

Accordingly, in the case where a photosensitive member is subjected to a pre-exposure for removing the charge therefrom prior to the charging step, the potential on the photosensitive member before entering the nip region of the charging member is nearly 0 volt, so that the electric field on the upstream side is almost determined by the voltage applied to the charging member. On the other hand, in the case where such a charge removal step is not included, the electric field applied to the charging member is determined based on the magnitudes and polarities of the voltages for the charging and the transfer, i.e., based on the potential on the photosensitive member after the transfer and the voltage applied to the charging member.

In the case of charging a photosensitive member by charge injection, even if the resistivity of the charging member is in the range of $1\times10^4$–$1\times10^{10}$ ohm.cm at an electric field at a certain position thereof, if the resistivity exceeds $1\times10^{10}$ ohm.cm at an electric field of, e.g., 0.3×V/d (volt/cm), i.e., at an electric field at an applied voltage which is 0.3 times the voltage (V) applied to the charging member, the charging performance is remarkably lowered on a downstream side of the nip region of the photosensitive member, so that the charging may be well performed in a range of 70% of the applied voltage but is lowered for the remaining 30% of the applied voltage, thus making it difficult to charge the photosensitive member up to a desired potential by charge injection. In other words, the performance of charge injection to the photosensitive member is largely influenced by the resistivity in a lower electric field.

As is understood from the above analysis, it is important to use a contact charging member having a volume resistivity of $10^4$–$10^{10}$ ohm.cm as measured according to a dynamic resistivity measurement method in contact with a rotating conductive substrate in an electric field of from 20 (volt/cm) to V1 (volt/cm) to abut on a photosensitive member, wherein V1 denotes a larger one of electric fields (V−VD)/d and V/d. As a result, it becomes possible to provide a potential onto the photosensitive member, which is nearly identical to the applied voltage.

Good image formation may be performed if the potential on the photosensitive member is up to ca. 80% of the applied voltage. From this view point, it is also possible to use a contact charging member exhibiting a resistivity of $1\times10^4$–$1\times10^{10}$ ohm.cm in an electric field range of from $V_3$ (=0.2×V/d) to V1 (volt/cm). In the simultaneous development and cleaning or cleaner-less image forming method, it has been found that transfer residual toner having a polarity normally controlled within the charging member is liable to gradually leak out of the charging member during image formation if a potential difference between the potential on the photosensitive member and the applied voltage of the contact charging member exceeds a certain level (ca. 50 volts or more according to our knowledge). Accordingly, it is important to suppress the potential difference within an extent of not causing a negative memory due to light interruption during imagewise exposure.

On the other hand, in the case of using a charging member having a resistivity below $1\times10^4$ ohm.cm at an electric field caused by a voltage applied to the charging member, an excessive leakage current is liable to flow into scars or pinholes formed on the surface of the photosensitive member, thereby causing insufficient charging in the neighborhood, enlargement of the pinholes and conduction breakdown of the charging member. At the scars or pinholes on the photosensitive member, the electroconductive layer (metal substrate) of the photosensitive member is exposed to the surface to provide a potential of 0 volt on the photosensitive member, so that the maximum electric field applied to the charging member is determined by the voltage applied thereto.

This means that, even if the resistivity of the charging member is controlled within the range of $1\times10^4$–$1\times10^{10}$ ohm.cm at a single point of applied electric field, a charging failure or a poor withstand voltage characteristic results in some cases.

Accordingly, it is preferred to use a contact charging member having a resistivity in the range of $1\times10^4$ohm.cm–$1\times10^{10}$ ohm.cm in an applied electric field range of 20 (volt/cm) to V1 (volt/cm), wherein V1 is determined as a higher one between (i) a maximum electric field applied to the charging member for charging the photosensitive member, i.e., an electric field determined based on a difference between the potential of the photosensitive member at the upstream end of the charging member nip and the voltage applied to the charging member and (ii) an electric field determined based on a voltage applied to the charging member in the case where a pre-exposure step is present or scars or pinholes are present on the photosensitive member surface.

As the nip width between the charging member and the photosensitive member is increased, the contact area between these members is increased and the contact time is increased, so that the charging of the photosensitive member by charge injection is well performed. In order to provide a good charge injection performance even at a small nip width, the resistivity of the charging member is controlled so that its maximum value R1 and minimum value R2 in the applied electric field range satisfies $R1/R2 \leqq 1000$. This condition is desired so as to avoid an abrupt change during the step of effecting the charging within the nip, whereby the charge injection to the photosensitive member cannot be well followed but the photosensitive member passes through the nip region without being sufficiently charged.

In the case of using a contact charging member in combination with a photosensitive member not having a charge injection layer, the transfer residual toner cannot be uniformly charged to a prescribed polarity by AC discharge, and can be charged to prescribed polarity uniformly but is liable to be excessively charged to adversely affect the development performance in the case of DC discharge. In contrast thereto, by using a photosensitive member having a charge injection layer in combination with a contact charging member, the transfer residual toner can be uniformly charged to a prescribed polarity and with a well-controlled charge, thus allowing an excellent transfer residual toner recovery performance and providing an image forming method with a stable repetitive developing performance.

It is preferred that the contact charging member has a charging polarity in case of triboelectrification with a photosensitive member identical to the charging polarity of the photosensitive member. According to our knowledge, the charged potential of a photosensitive member charged by charge injection is attained as a sum of the charge injection and triboelectrification of the photosensitive member by contact with the contact charging member. If the contact charging member has a triboelectrification polarity by contact with the photosensitive member, which is opposite to the charging polarity of the photosensitive member, the resultant photosensitive member potential is lowered by a contribution of the triboelectrification to result in a potential difference between the contact charging member and the photosensitive member surface. The lowering in photosensitive member potential due to triboelectrification may be up to several tens of volts, the electric field can result in a lowering in performance of recovering and retaining transfer residual toner by the contact charging member or transfer of magnetic particles onto the photosensitive member when the contact charging member comprises such magnetic particles, leading to positive ghost or fog.

It is preferred that the contact charging member moves with a peripheral speed difference relative to the photosensitive member. By providing a difference between the peripheral moving speeds of the contact charging member and the photosensitive member, it becomes possible to obtain a charging stability for a long period, retain a long life of the photosensitive member and also realize a long life of the charging roller, thereby providing an image forming system with a highly stable charging performance and a long life. More specifically, a toner is liable to be attached onto the surface of the contact charging member, and the attached toner is liable to hinder the charging. The different peripheral speed between the photosensitive member and the contact charging member allows the supply of a substantially larger surface of the contact charging member for a unit surface area of the photosensitive member, thereby reducing the charging hindrance. When transfer residual toner arrives at the charging position, a portion of toner showing a smaller force of attachment onto the photosensitive member moves to the charging member under the action of an electric field to locally change the resistivity of the charging member surface, so that the charge injection path is interrupted to result in a charging failure. Such a difficulty can be alleviated by provision of the peripheral speed difference.

For the purpose of the simultaneous development and cleaning, the peripheral speed difference between the contact charging member and the photosensitive member is expected to physically peel off the attached toner from the photosensitive member to promote the recovery thereof under an electric field and more effective charge-control the transfer residual toner to improve the recovery thereof in the developing step.

In order to avoid the wearing and soiling of the surfaces of the photosensitive member and the contact charging member due to abrasion therebetween accompanying the peripheral speed difference, it is effective to use a photosensitive member having a surface showing a contact angle with water of at least 85 deg.

In the case of providing such a peripheral speed difference, it is preferred that the photosensitive member is moved at a peripheral speed V and the contact charging member (e.g., charging roller) is moved at a peripheral speed v, satisfying $|v/V| \geqq 1.1$, i.e., the contact charging member is moved at a higher peripheral speed which is at least 110% of that of the photosensitive member in terms of an absolute value, so as to provide a stable charging performance and an improved performance of transfer residual toner recovery in the development step.

In a preferred embodiment of the present invention, the contact charging member comprises magnetic particles, more preferably electroconductive magnetic particles having a volume resistivity controlled within the range of $10^4$–$10^9$ ohm.cm.

The magnetic particles may preferably have a particle size (volume-basis median diameter) of 5–200 $\mu$m, so that they are not readily attached to the photosensitive member but provide dense ears of magnetic brush on the charging roller, thereby providing an improved performance of charge injection to the photosensitive member. It is further preferred that the average particle size is in the range of 10–100 $\mu$m so as to effectively scrape the transfer residual toner on the photosensitive member and effectively take the toner electrostatically into the magnetic brush, thereby temporarily retaining the toner in the magnetic brush for reliable charge control. An average particle size of 10–50 $\mu$m is further preferred.

The average particle size of magnetic particles may be determined by using a laser diffraction-type particle size distribution meter ("HEROS", available from Nippon Denshi K.K.) to effect a measurement in a range of 0.05–200 $\mu$m divided into 32 channels along a logarithmic scale to measure the number of particles in each channel and determine a particle size giving a 50% volume or an accumulative volume-particle size curve as a median particle size.

Use of such magnetic particles as the contact charging member provides a remarkably increased number of contact points with the photosensitive member and is advantageous for providing a more uniform charge potential onto the photosensitive member. Further, as the magnetic brush rotates, magnetic particles directly contacting the photosensitive member are exchanged, so that the lowering in charge injection performance due to surface soiling of the magnetic particles can be remarkably reduced.

The gap (corresponding to 4 in FIG. 6) between an electroconductive retention member 1*a* carrying the magnetic particles thereon and a photosensitive member may preferably be in the range of 0.2–2 mm. Below 0.2 mm, it becomes difficult for the magnetic particles to pass through the gap and be smoothly conveyed on the retention member, thus being liable to cause a charging failure, excessive stagnation of the magnetic particles at the nip region and attachment of magnetic particles onto the photosensitive member. Above 2 mm, it becomes difficult to form a broad nip of the magnetic particles with the photosensitive member. The gap is more preferably 0.2–1 mm, further preferably 0.3–0.7mm.

In the present invention, it is preferred that the contact charging member (118 in FIG. 6) includes a magnet (1-*b*) so that the magnet generates a magnetic flux density B (T: Tesla) and the magnetic particles are provided with a maximum magnetization σB ($Am^2/kg$) at the magnetic flux density B, satisfying: $B \cdot \sigma_B \geqq 4$.

In the case where the above formula is satisfied, an appropriate degree of magnetic force acts on the magnetic particles so that the magnetic particles are retained by a sufficient force and the magnetic particles are not readily transferred to the photosensitive member.

The magnetic particles for use in the injection charging may comprise a material suitable for providing magnetic particles forming ears erected under the action of a magnetic field to form a magnetic brush. Examples of such a material may include: an alloy or compound containing a ferromagnetic element, such as iron, cobalt or nickel; a ferrite having a resistivity adjusted by oxidation or reduction; and Zn—Cu ferrite reduced with hydrogen. In order to provide a ferrite with a resistivity in an electric field respectively as described above, the ferrite may be composed of an adjusted composition of metals. An increase in amount of divalent metals other than iron provides a lower resistivity and is liable to cause an abrupt lowering in resistivity.

The triboelectrification polarity of the magnetic particles may desirably be not opposite to the charging polarity of the photosensitive member as the lowering in charge potential of the photosensitive member by the amount of the triboelectrification provides a force in a direction of promoting transfer of the magnetic particles toward the photosensitive member, so that a condition for the retention of the magnetic particles on the contact charging member becomes severer. The triboelectrification polarity of the magnetic particles may for example be controlled by surface-treating the magnetic particles.

The surface treatment may be performed by surface-coating the magnetic particles with a vapor deposition film, an electroconductive resin film, an electroconductive pigment-dispersed resin film, etc. Such a surface coating layer need not completely cover the magnetic particles, but the magnetic particles can be exposed through the coating layer. The surface layer can even be formed discretely within an extent of adequately modifying the triboelectrification characteristic of the magnetic particles.

In view of the productivity and production cost, it is preferred to coat the magnetic particles with an electroconductive pigment-dispersed resin film. Further, in order to suppress the electric field-dependence of the resistivity, it is preferred to form a resinous coating film comprising electron conduction-type electroconductive pigment dispersed in a high-resistivity binder resin.

It is important that the magnetic particles after the coating has a resistivity within the above-described range. It is further preferred that the core magnetic particles have a resistivity in the above-described range in order to avoid an abrupt decrease in resistivity on a higher electric field side and provide a broad latitude for alleviating the occurrence of leak image due to the size and depth of flaws or defects on the photosensitive member.

Examples of a binder resin for coating the magnetic particles may include: vinyl resins, polycarbonate, phenolic resin, polyesters, polyurethane, epoxy resin, polyolefins, fluorine-containing resin, silicone resins and polyamides. In order to prevent the toner soiling, it is preferred to use a resin having a low critical surface tension. Examples of preferred resin may include: polyolefin, fluorine-containing resin and silicone resin.

Further, from a viewpoint of providing a broad latitude for alleviating the occurrence of leak images due to a resistivity lowering on a higher electric field side or due to flaws on the photosensitive member, it is preferred to coat the magnetic particles with a silicone resin having a high withstand voltage characteristic.

Examples of the fluorine-containing resin may include: polyvinyl fluoride, polyvinylidene fluoride, polytrifluoroethylene, polychlorotrifluoroethylene, polydichlorodifluoroethylene, polytetrafluoroethylene and polyhexafluoropropylene; and solvent-soluble copolymers of fluorine-containing monomers providing such fluorine-containing resin and another monomer copolymerizable therewith.

Examples of the silicone resin as a binder resin may include: KR271, KR282, KR311, KR255, KR155 (straight silicone varnish), KR211, KR212, KR216, KR213, KR217, KR9218 (modifying silicone varnish). SA-4, KR206, KR5206 (silicone alkyl varnished), ES1001, ES1001N, ES1002T, ES1004 (silicone epoxy varnish), KR9706 (silicone acrylic varnish), KR5203 and KR5221 (silicone polyester varnish), respectively available from Shin-Etsu Silicone K.K.; and SR2100, SR2101, SR2107, SR2110, SR2108, SR2109, SR2400, SR2410, SR2411, SH805, SH806 and SH840, respectively available from Toray Silicone K.K.

The electroconductive fine particles or pigment particles to be dispersed in the coating binder resin may comprise: a metal, such as copper, nickel, iron, aluminum, or silver; a metal oxide, such as iron oxide, ferrite, zinc oxide, tin oxide, antimony oxide or titanium oxide; or electron conduction-type electroconductive powder, such as carbon black. It is also possible to use an ionic conductive substance, such as lithium perchlorate and quaternary ammonium salts.

The image forming system shown in FIG. 5 may be operated in the same manner as in the system shown in FIG. 1 with respect to the steps after the charge injection-type charging step as described above.

Hereinbelow, the present invention will be described with reference to specific examples.

Production Example 1 for non-magnetic toner

| | | |
|---|---|---|
| Polyester resin (Mw (weight-average molecular weight) = $2 \times 10^5$; $PM_L$ (low-molecular weight-side peak molecular weight) = ca. 7000, Tg (glass transition point) = 63° C.) | 100 | wt. parts |
| Carbon black | 7 | wt. parts |
| Mono-azo dye iron complex (negative charge control agent) | 2 | wet. parts |
| Low-molecular weight polypropylene (release agent) | 2 | wt. parts |

The above ingredients were blended in a blender and then melt-kneaded through a twin-screw extruder heated at 130° C. After cooling, the melt-kneaded product was coarsely crushed by a hammer mill, finely pulverized by a jet mill and then strictly classified by a multi-division classifier utilizing the Coanda effect to obtain non-magnetic toner particles.

The thus-obtained non-magnetic toner particles showed shape factors SF-1 of 163 and SF-2 of 155. The non-magnetic toner particles were subjected to surface treatment under application of a thermo-mechanical impact (at 60° C.) by using a surface property-modifying apparatus ("Hybridizer", available from Nara Kikai Seisakusho K.K.) to obtain non-magnetic toner particles having shape factors SF-1 of 145 and SF-2 of 122. The non-magnetic toner particles having the thus lowered shape factors in 100 wt. parts were blended with 1.8 wt. parts of hydrophobic dry-process silica fine particles ($DP_1$ (number-average primary particle size)=12 nm, Sb (BET specific surface area)=120 $m^2/g$) formed after hydrophobization with dimethylsilicone oil and hexamethyldisilazane, and 0.3 wt. part of spherical polymethyl methacrylate fine particles (ψ (surface area-based sphericity)=0.99, $DP_1$=400 nm, Sb=15 $m^2/g$; Tg=125° C.; Mw=$3\times10^5$), externally added thereto, to obtain Non-magnetic toner (A).

The thus-obtained Non-magnetic toner (A) showed $D_4$ (weight-average particle size)=6.6 μm and $D_1$ (weight average particle size)=5.4 μm as measured by using a Coulter counter ("Multisizer", available from Coulter Electronics Inc.), SF-1=145, and SF-2=122. The properties of Non-magnetic toner (A) are show in Tables 1A and 1B appearing hereinafter together with those of Non-magnetic toners obtained in the following Production Examples.

Production Example 2 for non-magnetic toner

| | | |
|---|---|---|
| Styrene-butyl acrylate-monobutyl maleate copolymer (Mw = $3\times10^5$, $PM_L$ = ca. $10^4$, Tg = 62° C.) | 100 | wt. parts |
| Carbon black | 7 | wt. parts |
| Monoazo dye iron complex (negative charge control agent) | 2 | wt. parts |
| Low-molecular weight polypropylene (release agent) | 2 | wt. parts |

Non-magnetic toner particles were prepared similarly as in Production Example 1 except for using the above ingredients.

The thus-obtained non-magnetic toner particles showed shape factors SF-1 of 157 and SF-2 of 150. The non-magnetic toner particles were subjected to surface treatment under application of a thermo-mechanical impact (at 64° C.) by using the same surface property-modifying apparatus as in Production Example 1 to obtain non-magnetic toner particles having shape factors SF-1 of 152 and SF-2 of 130. The non-magnetic toner particles having the thus lowered shape factors in 100 wt. parts were blended with 1.8 wt. parts of hydrophobic dry-process silica fine particles ($DP_1$=8 nm, Sb=100 $m^2/g$) formed after hydrophobization with dimethylsilicone oil and 0.3 wt. part of spherical polymethyl methacrylate fine particles (ψ=0.97, $DP_1$=400 nm, Sb=15 $m^2/g$; Tg=128° C.; Mw=$3.5\times10^5$), externally added thereto, to obtain Non-magnetic toner (B).

The thus-obtained Non-magnetic toner (B) showed $D_4$=6.8 μm and $D_1$=5.9 μm, SF-1=152, and SF-2=131.

Production Example 3 for non-magnetic toner

Non-magnetic toner (C) was prepared in a similar manner as in Production Example 1 except for using 0.5 wt. part of spherical silica fine particles (ψ=0.99; $DP_1$=100 nm; Sb=20 $m^2/g$) instead of the spherical polymethyl methacrylate fine particles.

Production Example 4 for non-magnetic toner

Non-magnetic toner (D) was prepared in a similar manner as in Production Example 2 except for using 0.5 wt. part of spherical silica fine particles (ψ=0.98; $DP_1$=100 nm; Sb=20 $m^2/g$) instead of the spherical polymethyl methacrylate fine particles.

Production Example 5 for non-magnetic toner

Comparative Non-magnetic toner (i) was prepared in a similar manner as in Production Example 1 except for omitting the spherical polymethyl methacrylate fine particles.

Production Example 6 for non-magnetic toner

Comparative Non-magnetic toner (ii) was prepared in a similar manner as in Production Example 2 except for omitting the spherical polymethyl methacrylate fine particles.

Production Example 7 for non-magnetic toner

Comparative Non-magnetic toner (iii) was prepared in a similar manner as in Production Example 1 except for using non-magnetic toner particles having SF-1 of 163 and SF-2 of 155 before the treatment by application of a thermo-mechanical impact, as they were, for blending with the fine particles.

Production Example 8 for non-magnetic toner

Comparative Non-magnetic toner (iv) was prepared in a similar manner as in Production Example 2 except for using non-magnetic toner particles having SF-1 of 157 and SF-2 of 150 before the treatment by application of a thermo-mechanical impact, as they were, for blending with the fine particles.

Production Example 9 for non-magnetic toner

Comparative Non-magnetic toner (v) was prepared in a similar manner as in Production Example 1 except for using styrene/methyl methacrylate copolymer fine particles (ψ=0.8; $DP_1$=600 nm; Sb=12.5 $m^2/g$; Tg=98° C.; copolymerization weight ratio=75/25; Mw=$5\times10^5$) instead of the spherical polymethyl methacrylate fine particles.

Production Example 10 for non-magnetic toner

| | | |
|---|---|---|
| Polyester resin (Mw = $1\times10^5$, $PM_L$ = 6000, Tg = 55° C.) | 100 | wt. parts |
| Copper phthalocyanine (colorant) | 7 | wt. parts |
| Dialkylsalicyclic acid metal compound (negative charge control agent) | 2 | wt. parts |
| Ester wax (release agent) | 2 | wt. parts |

Non-magnetic toner (E) was prepared similarly as in Production Example 1 except for using the above ingredients.

The properties of Non-magnetic toners prepared in the above Production Examples are inclusively shown in Tables 1A and 1B. Further, the properties of the additives used for preparing the respective non-magnetic toners are inclusively shown in Table 2.

TABLE 1A

| Non-magnetic toner | Properties of toner particles | | | | | | | | | |
|---|---|---|---|---|---|---|---|---|---|---|
| | SF-1 | SF-2 | $\frac{(SF-1)-100}{SF-2-100}$ | Sb $m^2/cm^3$ | D4 $\mu m$ | D1 $\mu m$ | ρ* $g/cm^3$ | St $m^2/cm^3$ | Sb/St | 60%-pore radius nm |
| (A) | 145 | 122 | 0.49 | 1.79 | 6.6 | 5.8 | 1.10 | 0.91 | 1.97 | 2.1 |
| (B) | 152 | 130 | 0.58 | 1.68 | 6.8 | 5.9 | 1.05 | 0.88 | 1.91 | 2.5 |
| (C) | 145 | 122 | 0.49 | 1.79 | 6.6 | 5.8 | 1.10 | 0.91 | 1.97 | 2.1 |
| (D) | 145 | 122 | 0.49 | 1.79 | 6.6 | 5.8 | 1.10 | 0.91 | 1.97 | 2.1 |
| (E) | 147 | 125 | 0.53 | 1.70 | 6.2 | 5.3 | 1.10 | 0.97 | 1.75 | 2.3 |
| Comp. | | | | | | | | | | |
| (i) | 145 | 122 | 0.49 | 1.79 | 6.6 | 5.8 | 1.10 | 0.91 | 1.97 | 2.1 |
| (ii) | 152 | 130 | 0.58 | 1.68 | 6.8 | 5.9 | 1.05 | 0.88 | 1.91 | 2.5 |
| (iii) | 163 | 158 | 0.92 | 1.88 | 9.5 | 8.0 | 1.10 | 0.63 | 2.98 | 4.0 |
| (iv) | 157 | 150 | 0.87 | 1.98 | 8.3 | 7.2 | 1.05 | 0.72 | 2.75 | 3.7 |
| (v) | 145 | 122 | 0.49 | 1.79 | 6.6 | 5.8 | 1.10 | 0.91 | 1.97 | 2.1 |

| Non-magnetic toner | Properties of toner | | | | | | | | | |
|---|---|---|---|---|---|---|---|---|---|---|
| | SF-1 | SF-2 | $\frac{(SF-1)-100}{SF-2-100}$ | Sb $m^2/cm^3$ | D4 $\mu m$ | D1 $\mu m$ | ρ* $g/cm^3$ | St $m^2/cm^3$ | Sb/St | St × 1.5 + 1.5 |
| (A) | 144 | 122 | 0.49 | 5.5 | 6.6 | 5.8 | 1.10 | 0.91 | 6.0 | 2.9 |
| (B) | 152 | 131 | 0.60 | 5.8 | 6.8 | 5.9 | 1.05 | 0.88 | 6.6 | 2.8 |
| (C) | 143 | 124 | 0.56 | 5.6 | 6.6 | 5.8 | 1.10 | 0.91 | 6.2 | 2.9 |
| (D) | 144 | 125 | 0.57 | 6.0 | 6.6 | 5.8 | 1.10 | 0.91 | 6.6 | 2.9 |
| (E) | 148 | 127 | 0.56 | 5.4 | 6.2 | 5.3 | 1.10 | 0.97 | 5.6 | 3.0 |
| Comp. | | | | | | | | | | |
| (i) | 144 | 122 | 0.49 | 5.3 | 6.6 | 5.8 | 1.10 | 0.91 | 5.8 | 2.9 |
| (ii) | 152 | 131 | 0.60 | 5.6 | 6.8 | 5.9 | 1.05 | 0.88 | 6.8 | 2.8 |
| (iii) | 163 | 158 | 0.92 | 2.3 | 9.5 | 8.0 | 1.10 | 0.63 | 10.6 | 2.4 |
| (iv) | 156 | 151 | 0.91 | 2.5 | 8.3 | 7.2 | 1.05 | 0.72 | 8.6 | 2.6 |
| (v) | 143 | 123 | 0.53 | 5.5 | 6.6 | 5.8 | 1.10 | 0.91 | 5.8 | 2.9 |

*ρ: density

TABLE 1B

| Non-magnetic toner | Toner particle size distribution | | | Toner chargeability |
|---|---|---|---|---|
| | ≦5 $\mu m$ (% by number) | Dv* ($\mu m$) | ≧8 $\mu m$ (% by volume) | |
| (A) | 40 | 6.6 | 15 | 68 |
| (B) | 37 | 6.8 | 20 | 63 |
| (C) | 40 | 6.6 | 15 | 70 |
| (D) | 40 | 6.6 | 15 | 65 |
| (E) | 46 | 6.2 | 6 | 75 |
| Comp. (i) | 40 | 6.6 | 15 | 57 |

TABLE 1B-continued

| Non-magnetic toner | Toner particle size distribution | | | Toner chargeability |
|---|---|---|---|---|
| | ≦5 $\mu m$ (% by number) | Dv* ($\mu m$) | ≧8 $\mu m$ (% by volume) | |
| Como. (ii) | 37 | 6.8 | 20 | 55 |
| Comp. (iii) | 15 | 9.5 | 65 | 31 |
| Comp. (iv) | 24 | 8.3 | 55 | 37 |
| Comp. (v) | 40 | 6.6 | 15 | 59 |

*Dv: volume-average particle size

TABLE 2

| Non-magnetic toner | Inorganic fine particles (a) | | | | Spherical fine particles (b) | | | | |
|---|---|---|---|---|---|---|---|---|---|
| | Species | $DP_1$ (nm) | Sb ($m^2/g$) | Amount (wt. parts) | Species* | $DP_1$ (nm) | ψ | Sb ($m^2/g$) | Amount (wt. parts) |
| (A) | Silica | 12 | 120 | 1.8 | S. PMMA | 400 | 0.99 | 15 | 0.3 |
| (B) | " | 8 | 100 | 1.8 | " | 400 | 0.99 | 15 | 0.3 |
| (C) | " | 12 | 120 | 1.8 | S. Silica | 100 | | 20 | 0.5 |
| (D) | " | 8 | 100 | 1.8 | " | 100 | | 20 | 0.5 |
| (E) | " | 12 | 120 | 1.8 | S. PMMA | 400 | 0.99 | 15 | 0.3 |
| Comp. | | | | | | | | | |
| (i) | " | 12 | 120 | 1.8 | — | — | — | — | — |
| (ii) | " | 8 | 100 | 1.8 | — | — | — | — | — |
| (iii) | " | 12 | 120 | 0.5 | S. PMMA | 400 | 0.99 | 15 | 0.3 |
| (iv) | " | 8 | 100 | 0.5 | " | 400 | 0.99 | 15 | 0.3 |
| (v) | " | 12 | 120 | 1.8 | St/MMA | 600 | 0.80 | 12.5 | 0.3 |

*:S. MMA: spherical polymethyl methacrylate particles
S. Silica: spherical silica particles
St/MMA: styrene/methylmethacrylate copolymer particles Example 1 (photosensitive member)

Figure 3:
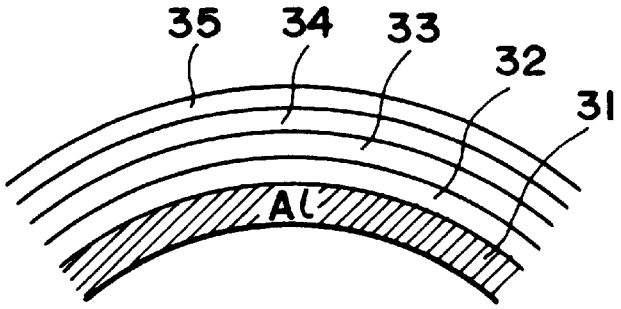
FIG. 3 is a partial sectional view showing a laminate structure example of a photosensitive member as an electrostatic latent image-bearing member.

Photosensitive member No. 1 was prepared by coating an aluminum cylinder (31) of 30 mm in diameter successively with the following layers by dipping to form a laminate structure as shown in FIG. 3.

(32) Electroconductive coating layer:

Formed in a thickness of 15 μm with phenolic resin containing powders of tin oxide and titanium oxide dispersed therein.

(33) Undercoating layer:

Formed in a thickness of 0.6 μm with modified nylon and copolymer nylon.

(34) Charge generation layer:

Formed in a thickness of 0.6 μm with butyral resin containing oxytitanium phthalocyanine dispersed therein having an absorption in a long-wavelength region.

(35) Charge transport layer:

Formed in a thickness of 20 μm by applying a coating liquid obtained by dissolving a hole-transporting triphenylamine compound and polycarbonate resin (having a molecular weight of 20,000 according to an Ostwald viscometer) in a weight ratio of 8:10 and further uniformly dispersing polytetrafluoroethylene powder (particle size:0.2 μm) in 5 wt. % of the total solid content. The surface layer showed a contact angle θ with water of 93 degrees.

The contact angle was measured by using pure water and a contact angle meter ("Model CA-DS", available from Kyowa Kaimen Kagaku K.K.).

Production Example 2 (photosensitive member)

Photosensitive member No. 2 was prepared in the same manner as in Production Example 1 up to the formation of the charge generation layer. A 18 μm-thick charge-transport layer was formed thereon with a mutually dissolved 10:10 weight mixture of the hole-transporting triphenylamine compound and the polycarbonate resin, and further coated with a 5 μm-thick protective layer formed by applying a coating liquid obtained by dissolving the same triphenylamine compound and polycarbonate resin in a weight ratio of 5:10 and further uniformly dispersing polytetrafluoroethylene powder (particle size:0.2 μm) in 30 wt. % of the total solid content. The protective layer showed a contact angle θ with water of 101 degrees.

Production Example 3 (photosensitive member)

Photosensitive member No. 3 was prepared in the same manner as in Production Example 1 except that the charge generation layer and the charge transport layer were formed as follows.

(34) Charge generation layer:

Formed in a thickness of 0.6 μm with butyral resin containing an azo pigment dispersed therein having an absorption in a long-wavelength region.

(35) Charge transport layer:

Formed in a thickness of 22 μm by applying a coating liquid obtained by dissolving a hole-transporting triphenylamine compound and polycarbonate resin (having a molecular weight of 20,000 according to an Ostwald viscometer) in a weight ratio of 8:10 and further uniformly dispersing polytetrafluoroethylene powder (particle size:0.2 μm) in 10 wt. % of the total solid content. The surface layer showed a contact angle θ with water of 96 degrees.

Production Example 4 (photosensitive member)

Photosensitive member No. 4 was prepared in the same manner as in Production Example 3 except for omitting the polytetrafluoroethylene powder from the charge transport layer. The surface layer showed a contact angle with water of 74 degrees.

The surface potential-exposure intensity characteristics of the photosensitive members prepared in the above Production Examples were measured in the following manner.

More specifically, each sample photosensitive member was charged to a prescribed dark-part potential and then exposed continuously to laser light having a wavelength identical to that of a laser beam printer ("LBP-860", mfd. by Canon) hereinafter. Thereafter, the resultant surface potential was measured. By repeating the operation at various exposure intensities, a surface potential-exposure intensity characteristic curve was obtained for a sample photosensitive member.

FIG. 14 shows a surface potential-exposure intensity characteristic curve of the photosensitive member obtained in Production Example 1 obtained by taking the dark-part potential at −700 volts. As shown in FIG. 14, the half-attenuation intensity E½ (i.e., an exposure intensity by which the dark-potential was lowered to a half thereof (i.e., −350 volts) was 0.12 cJ/cm$^2$. The residual potential Vr (i.e., a potential given by irradiation with 30 time the half-attenuation intensity (=3.6 cJ/m$^2$)) was −55 volts. A first slope given by connecting a point of Vd and a point at a potential of (Vd+Vr)/2 (=(−700−55)/2=−378 volts) was about (−378+700)/0.11=ca. 2900 volt m$^2$/cJ. Accordingly, a second slope was ca. 150 Vm$^2$/cJ (=2900/20). Emin given at a contact point between a tangential line having the slope 150 Vm/cJ and the characteristic curve was 0.43 cJ/m$^2$, and Emax was 0.60 cJ/m$^2$ (=0.12×5).

Similar measurements of the surface potential-exposure intensity characteristics and determination of the parameters were performed with respect to Photosensitive members Nos. 2–4 prepared by Production Examples 2–4. The results are summarized in the following Table 3.

TABLE 3

| Photosensitive member | No. 1 | | No. 2 | | No. 3 | | No. 4 | |
|---|---|---|---|---|---|---|---|---|
| Dark-part potential Vd | −700 | V | −700 | V | −700 | V | −700 | V |
| Residual potential Vr | −55 | V | −60 | V | −20 | V | −15 | V |
| (Vd + Vr)/2 | −378 | V | −380 | V | −360 | V | −358 | V |
| 1st slope: Vd − (Vd + Vr)/2 | 2900 | Vm$^2$/cJ | 3200 | Vm$^2$/cJ | 640 | Vm$^2$/cJ | 560 | Vm$^2$/cJ |
| 2nd slope: 1st slope/20 | 150 | Vm$^2$/cJ | 160 | Vm$^2$/cJ | 32 | Vm$^2$/cJ | 28 | Vm$^2$/cJ |
| Emin. (contact point with 2nd slope) | 0.43 | cJ/m$^2$ | 0.40 | cJ/m$^2$ | 2.45 | cJ/m$^2$ | 2.80 | cJ/m$^2$ |
| Emax. (= 5 × $E_{1/2}$) | 0.60 | cJ/m$^2$ | 0.60 | cJ/m$^2$ | 2.85 | cJ/m$^2$ | 3.10 | cJ/m$^2$ |
| Contact angle with water θ | 93 | deg. | 101 | deg. | 96 | deg. | 74 | deg. |

By using the above-prepared photosensitive members and non-magnetic toners, image formation was performed according to the following Examples.

EXAMPLE 1

A laser beam printer ("LBP-8 Mark IV", available from Canon K.K.) was used as an electrophotographic apparatus after remodeling. More specifically, the laser beam printer was remodeled into a form as briefly illustrated in FIG. 1 except for the organization of the contact charging member 117 and omission of the conveyer belt 125.

First of all, the cleaning rubber blade in the process cartridge for the printer was removed, and a contact charging device including a rubber roller supplied with a DC voltage of −1400 volts was incorporated.

Further, the developing device in the process cartridge was remodeled as follows. The stainless steel sleeve (toner-carrying member) was replaced by a toner-carrying member in the form of a roller (diameter: 16 mm) comprising a foam urethane, which was abutted against a photosensitive drum (photosensitive member). The toner carrying member was designed to rotate so as to provide a peripheral moving direction identical to that of the photosensitive drum at the position of contact with the photosensitive drum and a peripheral speed which was 150% of that of the photosensitive drum (i.e., process speed of 47 mm/sec).

Figure 2:
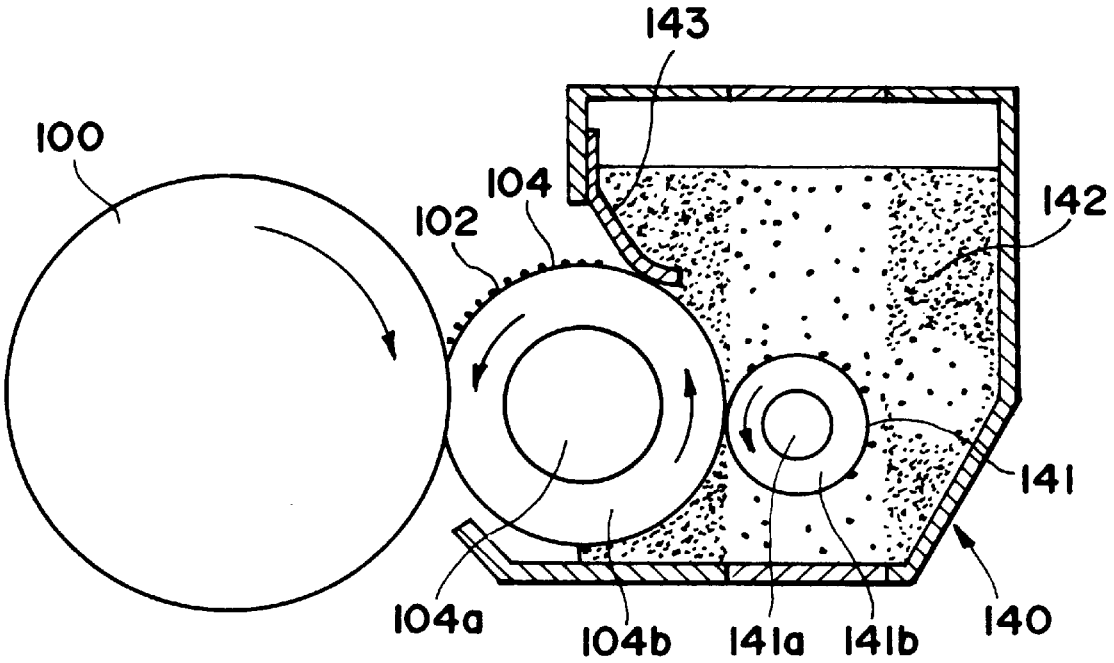
FIG. 2 is an enlarged illustration of the developing device in the apparatus of FIG. 1.

Similarly as shown in FIGS. 1 and 2, a toner application roller (141) supplied with a DC bias voltage of −420 volts was abutted against the toner-carrying member 104 as a means for applying a toner onto the toner-carrying member 104. Further, a resin-coated stainless steel blade 143 was disposed so as to regulate the toner coating layer on the toner-carrying member 104. The developing bias voltage applied to the toner-carrying member was only a DC component of −400 volts.

The photosensitive drum was charged to a dark part potential of −800 volts and exposed to provide a light-part potential of −150 volts as standard conditions.

According to the remodeled apparatus, the photosensitive drum was uniformly charged by the roller charger and then exposed to laser light so as to form an electrostatic latent image thereon. The latent image was then developed with Non-magnetic toner (A) on the toner-carrying member and the resultant toner image was transferred by a transfer roller supplied with a bias voltage onto a transfer material and then fixed by a hot-pressure roller fixing device.

Figure 4:
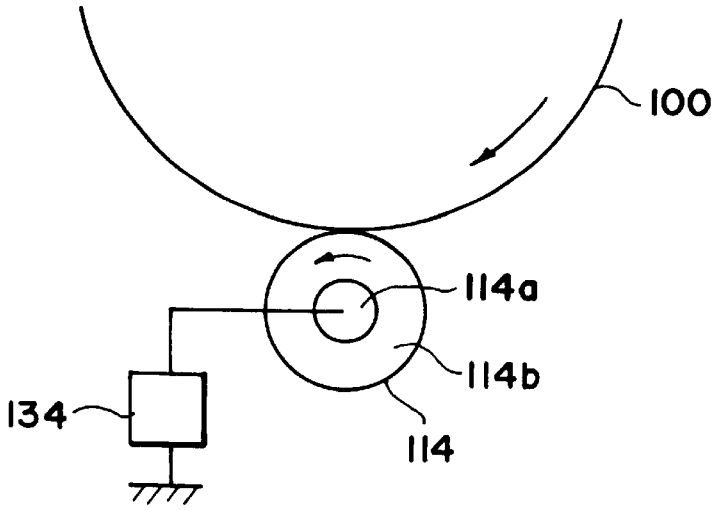
FIG. 4 is an enlarged illustration of an abutting transfer member.

The transfer roller was similar to a form as illustrated in FIG. 4 having electroconductive elastic layer comprising ethylene-propylene rubber containing electroconductive carbon disposed therein so as to provide a volume resistivity of $10^8$ ohm.cm, a surface rubber hardness of 24 deg. and a diameter of 20 mm. The transfer roller was abutted against the photosensitive drum at a pressure of 49 N/m (50 g/cm) and rotated at a peripheral speed of 48 mm/sec identical to that of the photosensitive drum while being supplied with a transfer bias voltage of +2000 volts.

Performance evaluation was performed by using Non-magnetic toner (A) in an environment of temperature 23° C. and humidity 65% RH.

In this specific example (Example 1), Photosensitive member No. 2 prepared in Production Example 2 (having a contact angle θ with water of 101 deg.) was used and charged to a dark-part potential of −800 volts. The charged photosensitive member was exposed at three different levels of exposure intensity as shown in Table 4, i.e.:0.25 cJ/$m^2$ (<Emin),0.85 cJ/$m^2$ (>Emax) and a medium level-intensities (0.50 cJ/$m^2$) between Emin and Emax. The exposure intensity of 0.50 cJ/$m^2$ provided a light-part potential of −150 volts and was adopted as a standard exposure intensity.

As shown in Table 4, fairly good images were obtained with respect to ghost, individual dot reproducibility, gradation reproducibility, image density, fog and continuous image forming characteristic at all three levels of exposure intensity, and particularly at a medium-level exposure intensity of 0.50 cJ/$m^2$.

In the above operation, a high transfer efficiency of 97% was attained from Photosensitive member No. 2 to the transfer material. Good images were obtained free from transfer dropout from character and line images and free of toner scattering.

The evaluation methods are described below.

[Evaluation]

Evaluations with respect to the following items (1)–(3) were performed after image formation on 100 sheets.

Figure 9:
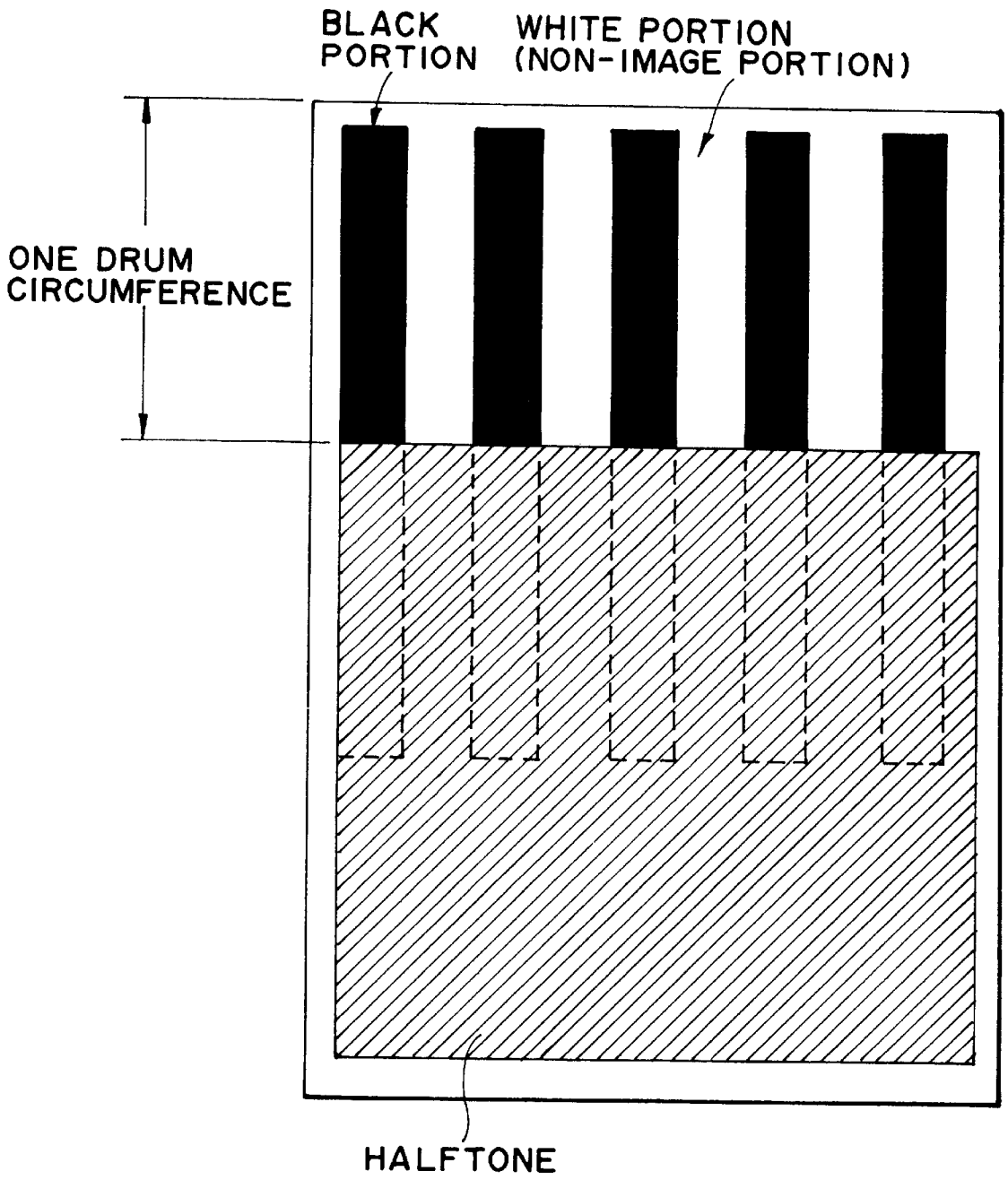
FIG. 9 is an illustration of a ghost evaluation image pattern.

(1) Ghost liable to be caused in a simultaneous development and cleaning scheme:

Image evaluation was performed by using a test pattern as shown in FIG. 9 comprising black and white stripes in a first region having a vertical length of one drum circumference and a subsequent halftone image region (corresponding to second and subsequent drum circumferences) formed by repetition of one black dot line and two blank dot lines respectively running laterally.

Test transfer materials included a plain paper of 75 g/$m^2$, a thick paper of 130 g/$m^2$, a thick paper of 200 g/$m^2$ and an overhead projector (OHP) film of polyethylene terephthalate.

Ghost image evaluation was performed by measuring reflection image densities by using a Macbeth reflection densitometer at portions in the second drum circumference region corresponding to the black print portion (black stripe portion) and the white non-image portion (white stripe portion) in the first drum circumference and taking a difference Ad therebetween, i.e., according to the following formula:

Δd=(reflection density at a portion corresponding to a black stripe portion)−(reflection density at a portion corresponding to a white stripe (non-image) portion).

Figure 10:
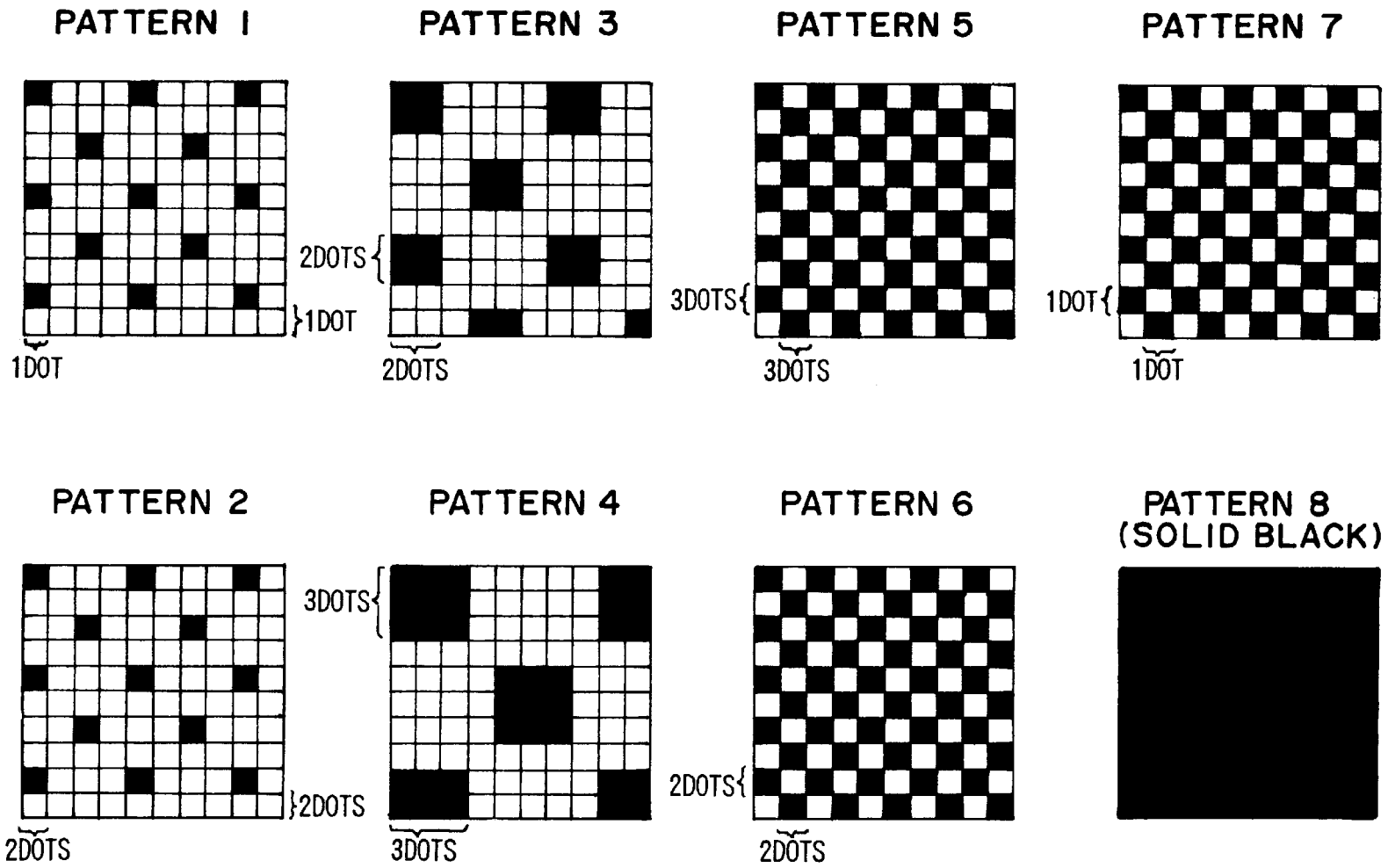
FIG. 10 is an illustration of a set of image patterns for evaluating gradation reproducibility.

The results are shown in Table 4. A smaller reflection density difference Δd (absolute value) represents a better ghost (prevention) performance. (2) Gradation reproducibility evaluation was performed by measuring image densities given by 8 dot arrangement patterns 1 to 8 as shown in FIG. 10, wherein one dot size was set to be 42 μm-square (600 dots/inch) while being indicated at different magnifications in FIG. 10.

The eight patterns were designed to provide the following density ranges, respectively.

| | |
|---|---|
| pattern 1 | 0.10–0.15, |
| pattern 2 | 0.15–0.20, |
| pattern 3 | 0.20–0.30, |
| pattern 4 | 0.25–0.40, |
| pattern 5 | 0.55–0.70, |
| pattern 6 | 0.65–0.80, |
| pattern 7 | 0.75–0.90, |
| pattern 8 | 1.35– |

The gradation reproducibility was evaluated to be excellent if all the above ranges were satisfied, fair if only one range was not satisfied, and poor if two or more ranges were not satisfied.

(3) Individual dot reproducibility in graphic images was evaluated by measuring the density of a reproduced image of Pattern 1. This is based on the fact that blurring of a latent image causes an enlarged developed area to provide an increased reproduced density. The evaluation was performed according to the following standard:

excellent: 0.10–0.15, fair: 0.16–0.17, poor: 0.18 or higher or below 1.0.

(4) Continuous image forming characteristic (CIFC) was evaluated for images obtained after image formation on 5000 sheets with respect to image defects attributable to melt-sticking of toner onto the photosensitive drum surface. The evaluation was performed by counting such image defects with eyes and indicated according to the following standard.

excellent: at most three image defects fair: 4–10 image defects poor: 11 or more image defects (5) Image density was measured with respect to a 5 mm-square solid black image by using a Macbeth densitometer.

(6) Fog was evaluated by measuring and recording a lowest reflectance Ds (%) on a white background portion on paper after printing and an average reflectance Dr (%) on a paper before printing by using a reflective densitometer ("REFLECTOMETER MODEL TC-6DS", available from TOKYO DENSHOKU K.K.), and a value (Dr–Ds) is recorded as fog (%). A fog value of 2% or less may be regarded as substantially fog-free and above 5% provides clear images with noticeable fog.

The evaluation results are inclusively shown in Table 4 appearing hereinafter together with those of the following Examples and Comparative Examples.

EXAMPLES 2–5

Image forming tests were performed in the same manner as in Example 1 except for using Non-magnetic toners (B)–(E), respectively, instead of Non-magnetic toner (A).

Comparative Examples 1–5

Image forming tests were performed in the same manner as in Example 1 except for using Comparative Non-magnetic toners (i)–(v), respectively, instead of Non-magnetic toner (A).

EXAMPLES 6–8

Image forming tests were performed in the same manner as in Example 1 except for using Photosensitive members Nos. 1, 3 and 4, respectively, instead of Photosensitive member No. 2 used in Example 1.

The results are inclusively shown in the following Tables 4 and 5.

TABLE 4

| Example | Exposure intensity (cJ/mm$^2$) | (1) Ghost evaluation 75 g/m$^2$ paper | 130 g/m$^2$ paper | 200 g/m$^2$ paper | OHP film | (3) Dot | (2) Gradation | (4) CIFC | (6) Fog | (5) I.D. |
|---|---|---|---|---|---|---|---|---|---|---|
| Ex. | | | | | | | | | | |
| 1 | 0.25 | 0 | 0 | 0 | 0 | excellent | excellent | excellent | 0.4 | 1.43 |
| | 0.50 | 0 | 0 | 0 | 0 | excellent | excellent | excellent | 0.3 | 1.44 |
| | 0.85 | 0 | 0 | 0 | 0 | fair | fair | excellent | 0.4 | 1.46 |
| 2 | 0.50 | 0 | 0 | 0 | −0.01 | excellent | excellent | excellent | 0.3 | 1.44 |
| 3 | 0.50 | 0 | 0 | 0 | 0 | excellent | excellent | fair | 0.5 | 1.38 |
| 4 | 0.50 | 0 | 0 | 0 | 0 | excellent | excellent | fair | 0.5 | 1.37 |
| 5 | 0.50 | 0 | 0 | 0 | 0 | excellent | excellent | excellent | 0.3 | 1.42 |
| Comp. Ex. | | | | | | | | | | |
| 1 | 0.50 | 0 | −0.01 | −0.01 | −0.02 | excellent | excellent | poor | 0.5 | 1.42 |
| 2 | 0.50 | 0 | −0.02 | −0.03 | −0.03 | excellent | excellent | poor | 0.6 | 1.43 |
| 3 | 0.50 | −0.01 | −0.02 | −0.04 | −0.05 | poor | poor | fair | 0.5 | 1.42 |
| 4 | 0.50 | −0.01 | −0.01 | −0.02 | −0.03 | poor | poor | fair | 0.5 | 1.43 |
| 5 | 0.50 | 0 | 0 | −0.01 | −0.02 | fair | fair | excellent | 0.7 | 1.27 |

(2) Gradation: Gradation reproducibility
(3) Dot: Dot reproducibility
(4) CIFC: Continuous image forming characteristic
(5) I.D.: Image density

TABLE 5

| Example | Exposure intensity (cJ/mm$^2$) | (1) Ghost evaluation 75 g/m$^2$ paper | 130 g/m$^2$ paper | 200 g/m$^2$ paper | OHP film | (3) Dot | (2) Gradation | (4) CIFC | (6) Fog | (5) I.D. |
|---|---|---|---|---|---|---|---|---|---|---|
| Ex. 6 | 0.25 | 0 | 0 | 0 | 0 | excellent | excellent | excellent | 0.3 | 1.41 |
| | 0.50 | 0 | 0 | 0 | 0 | excellent | excellent | excellent | 0.3 | 1.43 |
| | 0.85 | 0 | 0 | 0 | 0 | fair | fair | excellent | 0.4 | 1.43 |
| Ex. 7 | 2.0 | 0 | 0 | 0 | −0.01 | excellent | excellent | excellent | 0.4 | 1.43 |
| | 2.7 | 0 | 0 | 0 | 0 | excellent | excellent | excellent | 0.4 | 1.45 |
| | 3.5 | 0 | 0 | 0 | 0 | fair | fair | excellent | 0.4 | 1.47 |
| Ex. 8 | 2.5 | 0 | 0 | −0.01 | −0.02 | excellent | excellent | excellent | 0.4 | 1.42 |
| | 3.0 | 0 | 0 | 0 | −0.01 | excellent | excellent | excellent | 0.4 | 1.42 |
| | 3.5 | 0 | 0 | 0 | 0 | fair | fair | excellent | 0.5 | 1.44 |

(2)–(5): Same as in Table 4.

Magnetic particles A

Magnetic particles A for forming a magnetic brush charging roller were provided as magnetic ferrite particles having an average particle size of 25 μm and having a composition of $(Fe_2O_3)_{2.3}(Cu)_{1.0}(ZnO)_{1.0}$.

Magnetic particles B

Magnetic particles B were prepared by surface-coating Magnetic particles A with 0.05 wt. % of a titanate coupling agent ("KR TSS", available from Ajinomoto K.K.).

Magnetic particles C

Magnetic particles C were prepared by surface-oxidizing Magnetic particles A.

Magnetic particles D

Magnetic particles D were prepared by surface-coating 100 wt. parts of Magnetic particles C with 1 wt. part of silicone resin containing 10 wt. % of carbon black dispersed therein.

Magnetic particles E

Magnetic particles E were prepared by surface-oxidizing magnetite particles having an average particle size of 50 μm.

Figure 7:
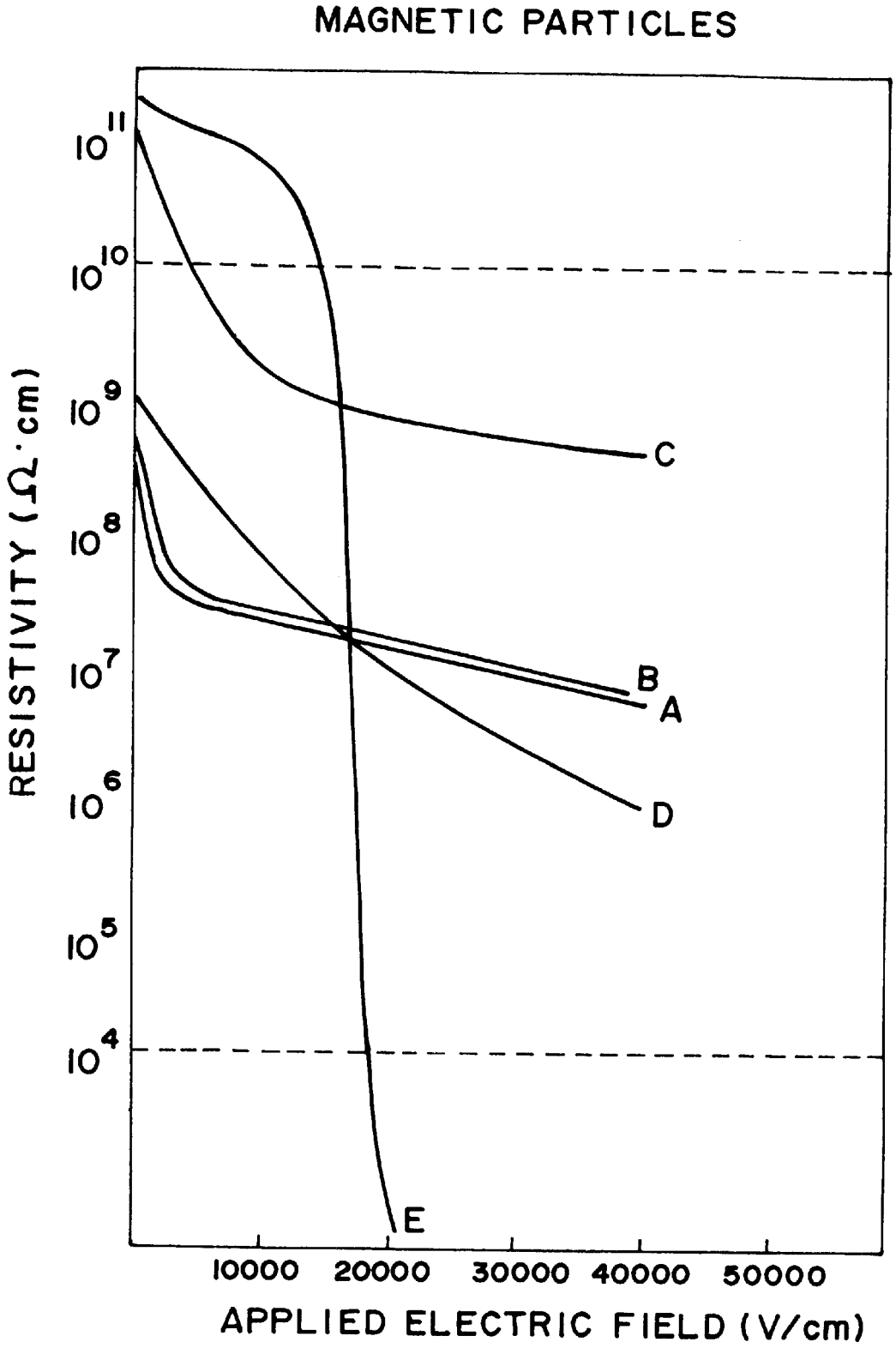
FIG. 7 is a graph showing an applied electric field-dependent change in resistivity of magnetic particles used in a contact charging member.

Magnetic particles A–E showed applied electric field-dependent resistivity characteristic as represented by curves A–E, respectively, in FIG. 7.

The average particle size and maximum magnetization $\theta_B$ ($Am^2/kg$) under an electric field of 796 A/m (10 k-Oersted) of Magnetic particles A–E are summarized in the following Table 6.

TABLE 6

| Magnetic particles | Average particle size (μm) | Maximum magnetization $^{\sigma}B$ ($Am^2/kg$) |
|---|---|---|
| A | 52 | 63 |
| B | 26 | 63 |
| C | 26 | 63 |
| D | 28 | 63 |
| E | 50 | 82 |

Production Example 5 (photosensitive member)

An OPC-type negatively chargeable Photosensitive member No. 5 was prepared by disposing the following 5 layers about a 30 mm-dia. aluminum cylinder.

A first layer was a ca. 20 μm-thick electroconductive particle-dispersed resin layer (electroconductive layer) for smoothening defects on the aluminum cylinder and preventing occurrence of noise due to reflection of exposure laser light.

A second layer was a positive charge injection-preventing layer (undercoating layer) for preventing positive charge injection from the aluminum support from diminishing negative charge provided to the photosensitive member surface and formed as a ca. 1 μm-thick layer with a medium level resistivity of ca. $10^6$ ohm.cm. with 6-66-610-12-nylon and methoxymethylated nylon.

A third layer was a ca.0.3 μm-thick charge generation layer comprising a disazo pigment dispersed in a resin and functional to generate positive and negative charge pairs when exposed to laser light.

A fourth layer was a ca. 25 μm-thick charge-transport layer comprising hydrazone dispersed in polycarbonate resin so as to form a p-type semiconductor. Accordingly, a negative charge formed on the photosensitive member surface could not move through this layer so that positive charge generated in the charge generation layer alone was transported to the photosensitive member surface.

A fifth layer was a charge injection layer, which comprised 100 wt. parts of a photocurable acrylic resin, 167 wt. parts of ca.0.03 μm-dia. $SnO_2$ particles provided with a lower resistivity by doping with antimony, 20 wt. parts of tetrafluoroethylene resin particles, and 1.2 wt. parts of a dispersant.

The charge injection layer was formed in a thickness of ca. 2.5 μm by spray coating of a liquid containing the above materials.

As a result, the volume resistivity of the photosensitive member surface layer was lowered to $5\times10^{12}$ ohm.cm in contrast with $1\times10^{15}$ ohm.cm in case of the charge transport layer alone. The surface layer showed a contact angle with water of 93 deg.

Production Example 6 (Photosensitive member)

Photosensitive member No. 6 was prepared in a similar manner as in Production Example 5 up to the formation of the undercoating layer. A 0.7 μm-thick charge injection layer was formed thereon as a layer of butyral resin containing oxytitanium phthalocyanine pigment having an absorption hand in a long-wavelength region dispersed therein, and further coated with a 18 μm-thick charge transport layer of a mutually dissolved 10:10 weight mixture of a hole-transporting triphenylamine compound and a polycarbonate resin. Then, the charge transport layer was further coated with a 3 μm-thick charge injection layer formed by spray coating of a coating liquid obtained by dissolving the same triphenylamine compound and the polycarbonate resin in a weight ratio of 5:10 and further uniformly dispersing therein 120 wt. parts of 0.03 μm-dia. low-resistivity $SnO_2$ particles per 100 wt. parts of the resin and 0.1 μm-dia. polytetrafluoroethylene resin particles in an amount of 30 wt. % of the total solid content. The photosensitive member surface exhibited a resistivity of $2\times10^{13}$ ohm.cm and a contact angle with water of 101 deg.

Production Example 7 (photosensitive member)

Photosensitive member No. 7 was prepared in the same manner as in Production Example 6 except that the polytetrafluoroethylene resin particles were omitted from the charge injection layer (surface layer). The resultant surface layer showed a contact angle with water of 78 deg.

Representative properties of Photosensitive members Nos. 5–7 thus prepared are summarized in the following Table 7.

TABLE 7

| Photosensitive member | No. 5 | | No. 6 | | No. 7 | |
|---|---|---|---|---|---|---|
| Dark-part potential Vd | −700 | V | −700 | V | −700 | V |
| Residual potential Vr | −55 | V | −60 | V | −50 | V |
| (Vd + Vr)/2 | −323 | V | −320 | V | −325 | V |
| 1st slope: Vd − £Vd + Vr)/2 | 920 | $Vm^2/cJ$ | 2900 | $Vm^2/cJ$ | 3200 | $Vm^2/cJ$ |
| 2nd slope: 1st slope/20 | 45 | $Vm^2/cJ$ | 150 | $Vm^2/cJ$ | 150 | $Vm^2/cJ$ |
| Emin. (contact point with 2nd slope) | 1.55 | $cJ/m^2$ | 0.43 | $cJ/m^2$ | 0.43 | $cJ/m^2$ |
| Emax. (= 5 × $E_{1/2}$) | 1.89 | $cJ/m^2$ | 0.60 | $cJ/m^2$ | 0.60 | $cJ/m^2$ |
| Contact angle with water θ | 93 | deg. | 101 | deg. | 78 | deg. |
| Surface volume resistivity | $1 \times 10^{13}$ | ohm.cm | $2 \times 10^{13}$ | ohm.cm | $2 \times 10^{15}$ | ohm.cm |

EXAMPLE 9

A laser beam printer ("LBP-860", available from Canon K.K.; process speed: 47 mm/sec) was remodeled in the following manner into the form roughly shown in FIG. 5.

The process speed was increased to 1.5 times, i.e., 70 mm/sec, and it was made possible to form a binary latent image at a resolution of 600 dots/inch. The cleaning rubber blade in the process cartridge of the printer was removed.

Referring to FIG. 1, in this specific example (Example 9), Photosensitive member No. 5 was used as a photosensitive member (100) in combination with contact charging member (117) formed by using Magnetic particles B so as to form a magnetic brush (117*a*) held on a non-magnetic electroconductive sleeve (117*b*) of aluminum having a sand-blasted surface. The sleeve (1-*a* in FIG. 6) was used to hold the magnetic particles (7 thereon) and form erected ears of the magnetic brush in combination with a magnet (1-*b* in FIG. 6) contained therein, and disposed to provide a gap (4 in FIG. 6) of ca. 500 $\mu$m from the photosensitive member (100 in FIG. 5) and a charging nip (3 in FIG. 6) of ca. 5 mm of the magnetic particles with the photosensitive member. The sleeve was rotated at a peripheral speed which was two times that of the photosensitive member in a direction opposite to that of the photosensitive member so that the magnetic brush thereon uniformly contacted the photosensitive member at a prescribed peripheral speed difference.

Herein, the peripheral speed difference is calculated as $(|V-v|/|V|)\times 100$, wherein V denotes a peripheral speed of the photosensitive member and v denotes a peripheral speed of the photosensitive member, respectively at a contact position therebetween.

The magnetic role exhibited a magnetic flux density of 0.1 T and was fixed so as to dispose its pole giving a maximum magnetic flux density opposite to the photosensitive member. Magnetic particles B exhibited a maximum magnetization at 0.1 T of ca. 63. ($Am^2/kg$).

Incidentally, in the case where the magnetic brush is fixed without providing a peripheral speed difference between the photosensitive member and the charging member, the magnetic brush is liable to fail in retaining an appropriate nip, thus resulting in charging failure, at the time of circumferential or axial deviation pushing the magnetic brush away, since the magnetic brush per se lacks a physical restoration force. For this reason, it is preferred that the magnetic brush is always pushed against the photosensitive member with its fresh surface. Accordingly, in this Example, the magnetic brush-holding sleeve was rotated at a peripheral speed two times that of and in a reverse direction with the photosensitive member.

Further, the developing device in the process cartridge was remodeled as follows. The stainless steel sleeve (toner-carrying member) was replaced by a toner-carrying member in the form of a roller (diameter: 16 mm) comprising a foam urethane, which was abutted against the photosensitive member. The toner carrying member was designed to rotate so as to provide a peripheral moving direction identical to that of the photosensitive drum at the position of contact with the photosensitive drum 906 and a peripheral speed which was 150% of that of the photosensitive drum (i.e., process speed of 47 mm/sec).

Similarly as shown in FIG. 2, a toner application roller (141) supplied with a DC bias voltage of −330 volts was abutted against the toner-carrying member 104 as a means for applying a toner onto the toner-carrying member 104. Further, a resin-coated stainless steel blade 143 was disposed so as to regulate the toner coating layer on the toner-carrying member 104. The developing bias voltage applied to the toner-carrying member was only a DC component of −300 volts.

According to the remodeled apparatus, the photosensitive member (No. 5) was uniformly charged to a potential of −680 volts by the contact charging member supplied with a DC bias voltage of −700 volts, and then exposed to laser light so as to form an electrostatic latent image thereon. The latent image was then developed with Non-magnetic toner (A) to form a toner image, which was then transferred onto a transfer material by means of a transfer member (114) supplied with a bias voltage and fixed onto the transfer material.

A continuous image formation test on 500 sheets was performed for each of the above-mentioned four types of transfer materials at an exposure intensity of 1.70 $cJ/m^2$ in an environment of 23° C. and 55% RH so as to evaluate image density, fog, ghost image and transfer dropout (hollow image) in character images at the initial stage, on 100-th sheet and on 500-th sheet, and gradation reproducibility at the initial stage.

The evaluation was performed in the following manner.

An overall ghost-prevention performance was performed based on a maximum reflection density difference among those obtained on the above-mentioned four types of transfer materials and rated according to the following standard.

AAA:0.00

AA:0.01–0.02

A:0.03–0.04

B:0.05–0.07

C:0.08–.

The hollow image (transfer dropout) evaluation was performed by forming a lattice pattern formed by drawing lines in a width of 3 dots (ca. 125 $\mu$m) each at a spacing of 15 dots (ca. 630 $\mu$m) each vertically and horizontally. The results were evaluated at three ranks at the following standard.

C: For the whole image, lines were reproduced so that only edges thereof were left and middle portion thereof were dropped out.

B: At a portion of the image, lines were reproduced so that only edges thereof were left and middle portion thereof were dropped out.

A: No dropout of middle portion was observed over the entire image.

Further, image forming performances were also evaluated with respect to items similar to those described in Example 1.

The results are shown in Tables 8 and 9 together with those of Examples and Comparative Examples described below.

EXAMPLES 10–13

Image forming tests were performed in the same manner as in Example 9 except for using Non-magnetic toners (B)–(E), respectively, instead of Non-magnetic toner (A).

Comparative Examples 6–10

Image forming tests were performed in the same manner as in Example 9 except for using Comparative Non-magnetic toners (i)–(v), respectively, instead of Non-magnetic toner (A).

TABLE 8

| Example | Image density | | | Fog | | | Ghost | | | Hollow image | | |
|---|---|---|---|---|---|---|---|---|---|---|---|---|
| | Initial | 100 sheets | 500 sheets | Initial | 100 sheets | 500 sheets | Initial | 100 sheets | 500 sheets | Initial | 100 sheets | 500 sheets |
| Ex. | | | | | | | | | | | | |
| 9 | 1.44 | 1.44 | 1.42 | 0.4 | 0.5 | 0.7 | AAA | AAA | AA | A | A | A |
| 10 | 1.45 | 1.44 | 1.43 | 0.4 | 0.3 | 0.4 | AAA | AAA | AA | A | A | A |
| 11 | 1.40 | 1.40 | 1.38 | 0.5 | 0.6 | 0.7 | AAA | AA | AA | A | A | A |
| 12 | 1.39 | 1.39 | 1.38 | 0.5 | 0.5 | 0.7 | AAA | AA | AA | A | A | A |
| 13 | 1.41 | 1.40 | 1.40 | 0.4 | 0.5 | 0.5 | AAA | AAA | AA | A | A | A |
| Comp. Ex. | | | | | | | | | | | | |
| 6 | 1.41 | 1.41 | 1.40 | 0.6 | 0.6 | 0.8 | AA | A | B | A | A | A |
| 7 | 1.43 | 1.42 | 1.40 | 0.6 | 0.6 | 0.7 | AA | A | B | A | A | A |
| 8 | 1.44 | 1.39 | 1.33 | 1.0 | 1.5 | 2.2 | B | B | C | C | C | C |
| 9 | 1.44 | 1.38 | 1.35 | 1.2 | 1.7 | 2.8 | B | C | C | C | C | C |
| 10 | 1.29 | 1.25 | 1.22 | 0.6 | 0.9 | 1.5 | AAA | A | A | B | B | B |

TABLE 9

| Example | Exposure intensity ($cJ/mm^2$) | (1) Ghost evaluation 75 $g/m^2$ paper | 130 $g/m^2$ paper | 200 $g/m^2$ paper | OHP film | (3) Dot | (2) Gradation | (4) CIFC | (6) Fog |
|---|---|---|---|---|---|---|---|---|---|
| Ex. | | | | | | | | | |
| 9 | 1.00 | 0 | 0 | 0 | 0 | excellent | excellent | excellent | 0.4 |
| | 1.70 | 0 | 0 | 0 | 0 | excellent | excellent | excellent | 0.5 |
| | 2.40 | 0 | 0 | 0 | 0 | fair | fair | excellent | 0.6 |
| 10 | 1.70 | 0 | 0 | 0 | 0 | excellent | excellent | excellent | 0.4 |
| 11 | 1.70 | 0 | 0 | 0 | 0 | excellent | excellent | excellent | 0.5 |
| 12 | 1.70 | 0 | 0 | 0 | 0 | excellent | excellent | excellent | 0.5 |
| 13 | 1.70 | 0 | 0 | 0 | 0 | excellent | excellent | excellent | 0.4 |
| Comp. Ex. | | | | | | | | | |
| 6 | 1.70 | 0 | 0 | 0 | −0.03 | excellent | excellent | fair | 0.6 |
| 7 | 1.70 | 0 | 0 | 0 | −0.03 | excellent | excellent | fair | 0.6 |
| 8 | 1.70 | 0 | −0.01 | −0.02 | −0.05 | poor | poor | excellent | 1.0 |
| 9 | 1.70 | 0 | −0.01 | −0.02 | −0.05 | poor | poor | excellent | 1.2 |
| 10 | 1.70 | 0 | 0 | 0 | −0.01 | fair | fair | excellent | 0.6 |

EXAMPLES 14–17

Image forming tests were performed in the same manner as in Example 9 except for using Magnetic particles A, C, D and E, respectively, instead of Non-magnetic particles B to constitute a magnetic brush charging roller. Example 17 using Magnetic particles E provided inferior results and the test was interrupted after 100 sheets.

EXAMPLES 18–19

Image forming tests were performed in the same manner as in Example 9 except for using Photosensitive members Nos. 6 and 7, respectively, instead of Photosensitive member No. 5. Example 19 using Photosensitive member No. 7 provided inferior results and the test was interrupted after 100 sheets.

The results of Examples 14–19 are inclusively shown in Tables 10 and 11.

TABLE 10

| Example | Image density | | | Fog | | | Ghost | | | Hollow image | | |
|---|---|---|---|---|---|---|---|---|---|---|---|---|
| | Initial | 100 sheets | 500 sheets | Initial | 100 sheets | 500 sheets | Initial | 100 sheets | 500 sheets | Initial | 100 sheets | 500 sheets |
| Ex. | | | | | | | | | | | | |
| 14 | 1.44 | 1.43 | 1.42 | 0.4 | 0.6 | 0.8 | AAA | AAA | AAA | A | A | A |
| 15 | 1.40 | 1.39 | 1.39 | 0.5 | 0.9 | 1.0 | AA | AAA | AA | A | A | A |
| 16 | 1.45 | 1.43 | 1.43 | 0.4 | 0.7 | 0.8 | AAA | AAA | AA | A | A | A |
| 17 | 1.30 | — | — | 0.8 | — | — | AAA | — | — | A | — | — |
| 18 | 1.43 | 1.43 | 1.42 | 0.3 | 0.4 | 0.5 | AAA | AAA | AAA | A | A | A |
| 19 | 1.45 | — | — | 1.3 | — | — | A | — | — | B | — | — |

TABLE 11

| Example | Exposure intensity (cJ/mm$^2$) | (1) Ghost evaluation 75 g/m$^2$ paper | 130 g/m$^2$ paper | 200 g/m$^2$ paper | OHP film | (3) Dot | (2) Gradation | (4) CIFC |
|---|---|---|---|---|---|---|---|---|
| Ex. | | | | | | | | |
| 14 | 1.70 | 0 | 0 | 0 | 0 | excellent | excellent | excellent |
| 15 | 1.70 | 0 | 0 | 0 | 0 | excellent | excellent | excellent |
| 16 | 1.70 | 0 | 0 | 0 | 0 | excellent | excellent | excellent |
| 17 | 1.70 | 0 | 0 | 0 | −0.01 | excellent | excellent | — |
| 18 | 0.50 | 0 | 0 | 0 | 0 | excellent | excellent | excellent |
| 19 | 0.50 | 0 | −0.01 | −0.04 | −0.05 | excellent | excellent | — |

What is claimed is:

1. An image forming method, comprising:

a charging step of charging an electrostatic latent image-bearing member by charging means, an exposure step of exposing the charged image-bearing member to form an electrostatic latent image thereon, a developing step of developing the electrostatic latent image with a non-magnetic toner held by developing means to form a toner image on the image-bearing member, and a transfer step of transferring the toner image on the image-bearing member onto a transfer material via or without via an intermediate transfer member, wherein (I) a portion of the toner remaining on the image-bearing member after the transfer step is recovered by the developing means during a subsequent developing step;

(II) the non-magnetic toner comprises non-magnetic toner particles having a shape factor SF-1 of 120–160, a shape factor SF-2 of 115–140 and a weight-average particle size of 4–9 $\mu$m; and (III) the non-magnetic toner further includes inorganic fine particles (a) having a number-average primary particle size of at most 50 nm and spherical fine particles (b) having a number-average primary particle size of 50–1000 nm and a surface area-based sphericity $\psi$ of 0.91–1.00, respectively externally added to the non-magnetic toner particles.

2. The image forming method according to claim 1, wherein the electrostatic latent image-bearing member is charged by a contact charging means which is supplied with a bias voltage and moves at a peripheral speed larger than that of the electrostatic latent image-bearing member.

3. The image forming method according to claim 2, wherein the contact charging means rotates in a direction causing a counter peripheral movement relative to the electrostatic latent image-bearing member at a contact position.

4. The image forming method according to claim 2, wherein the contact charging means moves at a peripheral speed which is 1.1 to 3 times that of the electrostatic latent image-bearing member.

5. The image forming method according to claim 1, wherein the developing means comprises a toner-carrying roller for carrying and conveying a layer of the non-magnetic toner, which contacts the electrostatic latent image-bearing member surface at a closest position therebetween.

6. The image forming method according to claim 5, wherein the toner-carrying roller rotates at a peripheral speed which is 1.1 to 3 times that of the electrostatic latent image-bearing member.

7. The image forming method according to claim 1, wherein the developing means comprises a toner-carrying roller and further includes an application roller for supplying the non-magnetic toner to the surface of the toner-carrying roller, and an application blade for forming a layer of the non-magnetic toner on the surface of the toner-carrying roller.

8. The image forming method according to claim 7, wherein the application roller and the toner-carrying roller in the developing means are respectively supplied with a DC bias voltage.

9. The image forming method according to claim 8, wherein the DC bias voltage supplied to the application roller has an identical polarity to that of and a larger absolute value than that of the DC bias voltage supplied to the toner-carrying roller.

10. The image forming method according to claim 1, wherein the inorganic fine particles (a) have a number-average primary particle size of 1–30 nm, and the spherical fine particles (b) have a number-average primary particle size of 70–900 nm.

11. The image forming method according to claim 10, wherein the spherical fine particles (b) are spherical resin fine particles.

12. The image forming method according to claim 11, wherein the spherical resin fine particles comprise a vinyl polymer or a vinyl copolymer.

13. The image forming method according to claim 11, wherein the spherical resin fine particles have a glass transition point of 8–150° C.

14. The image forming method according to claim 1, wherein the inorganic fine particles (a) are added in 0.1–8 wt. parts and the spherical fine particles (b) are added in 0.01–1.0 wt. parts, respectively per 100 wt. parts of the non-magnetic toner particles.

15. The image forming method according to claim 1, wherein the spherical fine particles (b) are spherical silica fine particles.

16. The image forming method according to claim 1, wherein the non-magnetic toner has a BET specific surface area Sb (m$^2$/cm$^3$) as measured by using nitrogen gas and a geometrical specific surface area St (m$^2$/cm$^3$) based on an assumption that it consists exclusively of true-spherical non-magnetic toner particles each having a weight-average particle size, satisfying:

$$3.0 \leqq Sb/St \leqq 7.0 \text{ and } Sb \geqq St \times 1.5 + 1.5.$$

17. The image forming method according to claim 16, wherein the non-magnetic toner particles have a number-average particle size of 3.5–8.0 $\mu$m.

18. The image forming method according to claim 17, wherein the non-magnetic toner particles have a number-average particle size $D_1$ ($\mu$m) satisfying:

$10 \leqq D_1 \times Sb \geqq 50$.

19. The image forming method according to claim 16, wherein the non-magnetic toner has a BET specific surface area of 1.2–2.5 $m^2/cm^3$.

20. The image forming method according to claim 1, wherein the non-magnetic toner particles provide a ratio B/A of at most 1.00, wherein B denotes a value obtained by subtracting 100 from the SF-2 value, and A denotes a value obtained by subtracting 100 from the SF-1 value.

21. The image forming method according to claim 20, wherein the ratio B/A of the non-magnetic toner particles is in the range of 0.20–0.90.

22. The image forming method according to claim 20, wherein the ratio B/A of the non-magnetic toner particles is in the range of 0.35–0.85.

23. The image forming method according to claim 1, wherein the inorganic fine particles (a) comprises an inorganic substance selected from the group consisting of silica, titanium oxide and alumina; and the spherical fine particles (b) are spherical resin fine particles.

24. The image forming method according to claim 23, wherein the inorganic fine particles (a) are hydrophobic silica fine particles.

25. The image forming method according to claim 23, wherein the inorganic fine particles (a) are hydrophobic titanium oxide fine particles.

26. The image forming method according to claim 23, wherein the inorganic fine particles (a) are hydrophobic alumina fine particles.

27. The image forming method according to claim 1, wherein the non-magnetic toner particles have a 60%-pore radius of at most 3.5 nm on an accumulative pore area—pore radius distribution curve in a pore radius range of 1–100 nm.

28. The image forming method according to claim 1, wherein the electrostatic latent image-bearing member has a surface showing a contact angle with water of at least 85 deg.

29. The image forming method according to claim 1, wherein the electrostatic latent image-bearing member has a surface showing a contact angle with water of at least 90 deg.

30. The image forming method according to claim 1, wherein the electrostatic latent image-bearing member has a surface layer comprising a fluorine-containing substance.

31. The image forming method according to claim 30, wherein the electrostatic latent image-bearing member has a surface layer containing fluorine-containing resin particles.

32. The image forming method according to claim 1, wherein the electrostatic latent image-bearing member is an OPC photosensitive member and is exposed in the exposure step at an exposure intensity which is at least a minimum exposure intensity and below a maximum exposure intensity; said minimum exposure intensity being determined on a surface potential-exposure intensity characteristic curve of the photosensitive member by determining a first slope S1 of a straight line connecting a point giving a dark part potential Vd and a point giving a value of (Vd+a residual potential Vr)/2, determining a contact point between a tangent line having a slope of S1/20 and the surface potential-exposure intensity characteristic curve and determining the minimum exposure intensity as an exposure intensity at the contact point; said maximum exposure intensity being determined as 5 times a half-attenuation exposure intensity.

33. The image forming method according to claim 1, wherein said electrostatic latent image-bearing member has a surface charge injection layer.

34. The image forming method according to claim 33, wherein the electrostatic latent image-bearing member is charged by means of a magnetic brush supplied with a bias voltage.

35. The image forming method according to claim 33, wherein the surface charge injection layer has a volume resistivity of $1\times10^8$–$1\times10^{15}$ ohm.cm.

36. The image forming method according to claim 35, wherein said electrostatic latent image-bearing member is charged by a contact charging member abutted thereto; said contact charging member having a volume resistivity of $10^4$–$10^{10}$ ohm.cm as measured according to a dynamic resistivity measurement method in contact with a rotating conductive substrate in an electric field of from 20 to V1 (volt/cm), wherein V1 denotes a larger one of electric fields (V−VD)/d and V/d, V denotes a voltage applied to the contact charging member, VD denotes a potential of the electrostatic latent image-bearing member immediately before contact with the contact charging member, and d denotes a gap between a voltage supplied part of the contact charging member and the electrostatic latent image-bearing member.

37. The image forming method according to claim 36, wherein said contact charging member comprises a magnetic brush formed of magnetic particles having a volume resistivity of $10^4$–$10^9$ ohm.cm.

* * * * *

UNITED STATES PATENT AND TRADEMARK OFFICE

CERTIFICATE OF CORRECTION

PATENT NO. : 5,915,150

DATED : June 22, 1999

INVENTOR(S) : TSUTOMU KUKIMOTO ET AL.

It is certified that error appears in the above-identified patent and that said Letters Patent is hereby corrected as shown below:

COLUMN 10

Line 30, "homologous" should read --homologs--.

COLUMN 13

Line 33, "well" should read --effectively--.

COLUMN 14

Line 19, "utmost" should read --outermost--; and
Line 28, "utmost" should read --outermost--.

COLUMN 15

Line 8, "S1of" should read --S1 of--.

COLUMN 22

Line 5, "flowed" should read --"lowered"--.

COLUMN 23

Line 25, "electric" should read --electric field--.

COLUMN 27

Line 16, "σB" should read --$\sigma_B$--.

UNITED STATES PATENT AND TRADEMARK OFFICE

CERTIFICATE OF CORRECTION

PATENT NO. : 5,915,150

DATED : June 22, 1999

INVENTOR(S) : TSUTOMU KUKIMOTO ET AL.

It is certified that error appears in the above-identified patent and that said Letters Patent is hereby corrected as shown below:

COLUMN 28

Line 29, "varnished)," should read --varnish),--; and
Production Example 1, "2 wet. parts" should read --2 wt. parts--.

COLUMN 34

Line 31, "time" should read --times--.

COLUMN 35

Line 57, "medium level-intensities" should read --medium-level intensity--.

COLUMN 36

Line 29, "Ad" should read --Δd--.

COLUMN 39

Line 22, "$\Theta_B$ should read --$\sigma_B$--; and
Table 6, "°B" should read --$\sigma_B$--.

COLUMN 40

Line 29, "hand" should read --band--; and
Table 7, "- £Vd" should read -- -(Vd--.

UNITED STATES PATENT AND TRADEMARK OFFICE

CERTIFICATE OF CORRECTION

PATENT NO. : 5,915,150

DATED : June 22, 1999

INVENTOR(S) : TSUTOMU KUKIMOTO ET AL.

It is certified that error appears in the above-identified patent and that said Letters Patent is hereby corrected as shown below:

COLUMN 42

Line 41, "portion" should read --portions--; and
Line 44, "portion" should read --portions--.

Signed and Sealed this

Thirtieth Day of May, 2000

*Attest:*

*Attesting Officer*

Q. TODD DICKINSON

*Director of Patents and Trademarks*